US007856969B2

(12) United States Patent
Maeda et al.

(10) Patent No.: US 7,856,969 B2
(45) Date of Patent: Dec. 28, 2010

(54) AIR GUN

(75) Inventors: Tetsuo Maeda, Tokyo (JP); Yoshiyuki Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 824 days.

(21) Appl. No.: 11/655,205

(22) Filed: Jan. 19, 2007

(65) Prior Publication Data

US 2010/0263652 A1 Oct. 21, 2010

(51) Int. Cl.
*F41B 11/00* (2006.01)

(52) U.S. Cl. ..... 124/71; 124/73; 124/76

(58) Field of Classification Search ..... 124/70–74, 124/76

See application file for complete search history.

(56) References Cited

U.S. PATENT DOCUMENTS

| | | | | | |
|---|---|---|---|---|---|
| 3,204,625 | A * | 9/1965 | Shepherd | ..... | 124/74 |
| 4,147,152 | A * | 4/1979 | Fischer et al. | ..... | 124/76 |
| 5,509,399 | A * | 4/1996 | Poor | ..... | 124/76 |
| 5,711,286 | A * | 1/1998 | Petrosyan et al. | ..... | 124/73 |
| 6,026,797 | A * | 2/2000 | Maeda et al. | ..... | 124/74 |
| 6,112,734 | A * | 9/2000 | Kunimoto | ..... | 124/73 |
| 6,497,229 | B1 * | 12/2002 | Maeda | ..... | 124/76 |
| 7,267,119 | B2 * | 9/2007 | Maeda et al. | ..... | 124/73 |
| 7,273,047 | B2 * | 9/2007 | Hu | ..... | 124/74 |
| 7,353,816 | B2 * | 4/2008 | Maeda et al. | ..... | 124/73 |
| 7,387,117 | B2 * | 6/2008 | Kunimoto | ..... | 124/73 |
| 2003/0230296 | A1 | 12/2003 | Farrell | | |
| 2006/0162711 | A1 | 7/2006 | Maeda et al. | | |

FOREIGN PATENT DOCUMENTS

| | | | |
|---|---|---|---|
| EP | 0 928 945 | A2 | 7/1999 |
| EP | 1 103 778 | A1 | 5/2001 |
| EP | 1 503 166 | A1 | 2/2005 |

OTHER PUBLICATIONS

Extended EPO Search Report, App. No. 06027082.4-1260, Jun. 2007 (7 pages).

* cited by examiner

*Primary Examiner*—Michael Carone
*Assistant Examiner*—Gabriel J Klein
(74) *Attorney, Agent, or Firm*—Rader, Fishman & Grauer PLLC

(57) ABSTRACT

In an air gun of the related art, even if it is attempted to independent and separately adjust a firing operation and a blowback operation, this type of independent adjustment is difficult.

This problem is solved by an air gun for firing a bullet using compressed gas, and having a mechanism for performing blowback, wherein the blowback mechanism is provided with a firing air chamber 25*a* and a blowback air chamber 25*b*, being two cavities capable of being supplied with compressed gas from a compressed gas source A and being sealed to contain the compressed gas, inside a valve body 24, a firing valve 27 inside the firing air chamber 25*a*, a blowback valve 29 inside the blowback air chamber 25*b*, and two valves 27, 29 that are capable of actuation independent of each other by operation of a trigger.

2 Claims, 26 Drawing Sheets

AIR GUN

BACKGROUND OF THE INVENTION

1. Field of the Invention

This invention relates to an air gun for carrying out firing and blowback with a compressed gas as an energy source, and has a structure for supplying energy for both firing of a bullet and carrying out blowback from a single compressed gas. In more detail, the invention relates to an air gun that performs firing of a bullet and blowback more efficiently than a conventional air gun for firing and carrying out blowback, and with which design of bullet firing and blowback adjustment can be made more simple.

2. Description of the Related Art

A mechanism of a conventional air gun, for firing a bullet using compressed gas and performing blowback, has a single air chamber, and a single valve is provided inside the air chamber. By distributing the gas inside the air chamber for firing use and blowback use, both firing and blowback are carried out by operating the single valve.

For example, as related art 1, U.S. patent application Ser. No. 11/024,479, applied by the present applicant (US application date: Dec. 20, 2004), discloses "An air gun, comprising:

a slide, provided in an upper part of a gun and capable of sliding parallel to a barrel;

a cylinder section, formed of a cylinder that is open at a muzzle side and closed off at a gun rear end side, fixed inside a gun rear end side of the slide;

a hit pin provided projecting from a hollow inner portion of the cylinder section to a gun rear end side, and being capable of sliding in a nozzle direction;

a hollow valve pin chamber fixed to the gun body so as to be positioned inside the hollow inner portion of the cylinder section;

a valve body having a through hole passing through from a muzzle side to a gun rear end side at a smaller diameter than the valve pin chamber; a gas supply port, opened to a cylindrical peripheral surface of the valve pin chamber, for constantly supplying compressed gas to the valve pin chamber of the valve body;

a valve pin, formed as a cylinder and provided inside the valve pin chamber, constantly urged to the gun rear end side and having a bullet nozzle insertion section formed at a muzzle side and inserted into the muzzle side through holes of the valve pin chamber to project, and a pin body that has a valve pin flange section, capable of sliding in an air-tight state in the muzzle side through hole of the valve pin chamber and contacts a gun rear end side surface of the valve pin in an air-tight manner at the gun rear end side, the valve pin communicating with a muzzle side providing a valve pin chamber side opening that opens to a pin body side surface at a muzzle side of a pressing section provided in the pin body;

a pressing section, provided at a gun rear side of the pin body, fixed to the valve body, inserted into rear end side through holes of the valve pin to project to the gun rear side, positioned so that a tip end of a gun rear side is adjacent to the hit pin, and capable of venting compressed gas from a gap between the rear end side through holes;

a bullet feed nozzle link for linking to a trigger; and a bullet feed nozzle, formed as a cylinder, inserted into a valve pin muzzle side bullet feed nozzle insertion section projecting to a muzzle side of the valve pin chamber, forming a rib-shaped bullet feed nozzle link engagement projection for engaging with the bullet feed nozzle link at an outer periphery of a gun rear end side, and being capable of sliding in the valve pin muzzle side bullet feed nozzle insertion section in order to load a bullet in the chamber in response to movement of the trigger and the bullet feed nozzle link, wherein when the hit pin is pressed to the muzzle side and made to slide to the muzzle side, the valve pin slides to the muzzle side against urging force to release an airtight state between the valve pin flange section and a side surface at the gun rear end side of the valve pin chamber, compressed gas supplied to the valve pin chamber from the gas supply port is supplied from between the side surface at the gun rear end side of the valve pin chamber and the valve pin flange section to the valve pin chamber side opening, and a bullet is fired from the muzzle by the supply of compressed gas through the bullet feed nozzle insertion section to the muzzle side of the bullet feed nozzle, and compressed gas is supplied from a gap between the pressing section and through holes into which the pressing section is inserted to the gun rear end side to cause the cylinder section to move to the gun rear end side.".

Also, as another embodiment of the invention of related art 1, there is disclosed an air gun as described above in which the cylinder section is provided freely moving inside a gun rear side of the slide, and there is no hit pin.

However, with the mechanism of the air gun disclosed in related art 1, firing and blowback are carried out using discharge of a single valve provided in a single air chamber, and since compressed gas is distributed for firing use and blowback use these actions are carried out at substantially the same time. Therefore, even if it is attempted to independent and separately adjust the firing operation and the blowback operation, this type of independent adjustment is difficult.

Also, with a structure such as that of related art 1, the firing operation and the blowback operation can not be independently adjusted separately at the design stage. That is, since distribution of gas pressure of the compressed gas is difficult, adjustment of bullet speed and adjustment of blowback strength and period, etc. at the time of design is extremely difficult.

SUMMARY OF THE INVENTION

In order to solve the above-described problems, there is proposed an air gun, for firing a bullet using compressed gas, and having a mechanism for performing blowback, wherein the blowback mechanism is provided with a firing chamber and a blowback chamber, being two cavities capable of being supplied with compressed gas from a compressed gas source and being sealed to contain the compressed gas, inside a valve body, a firing valve inside the firing chamber, a blowback valve inside the blowback chamber, and two valves that are capable of actuation independent of each other by operation of a trigger.

There is also proposed an air gun, for firing a bullet using compressed gas, and having a mechanism for performing blowback, wherein the blowback mechanism is provided with a firing chamber and a blowback chamber, being two cavities capable of being sealed to contain the compressed gas, inside a valve body, a firing valve inside the firing chamber, a blowback valve inside the blowback chamber, and two valves that are capable of actuation independent of each, and the firing valve is opened by actuation of a barrel latch actuated by a trigger operation, and the blowback valve is opened by actuation of a hammer actuated by the trigger operation.

There is further proposed an air gun having either of the two blowback mechanisms described above, wherein the firing chamber and the blowback chamber, being two cavities, are connected by a narrow connection passage having a small volume compared to the volume of the respective cavities between two air chambers.

There is still further proposed an air gun having either of the two blowback mechanisms described above, wherein the firing chamber and the blowback chamber, being two cavities, are connected to mutually independent compressed gas air sources.

According to this invention, since the chamber for bullet firing and the chamber for blowback are provided independently of each other, and respective valves are provided in each air chamber, the valve for bullet firing is opened by means of actuation of a barrel latch due to actuation of the trigger, and the valve for blowback is opened by means of impact of a hammer due to actuation of the trigger. Therefore, the respective chambers and valves operate independently and are not constrained by each other. Accordingly, factors such as extent of respective valve open areas, shortening of open time, and ease of opening etc. can be arbitrarily adjusted at the time of design, and the degree of distributing gas pressure of the compressed gas is also simplified. Adjustment of bullet speed and adjustment of blowback therefore become possible with adjustment in the design. For example, by shortening the open time of the bullet firing valve and widening the open area, substantially independently of the opening of the blowback valve, it is possible to send more compressed gas to the inner barrel, and the rate of fire of the bullets can be increased.

Further, the timing for bullet firing and blowback are respectively adjustable, which means that causing a blowback operation to be carried out after firing a bullet can be reliably performed in design. In this way, design and development of an air gun with further improved accuracy of fire is made easy.

DESCRIPTION OF THE PREFERRED EMBODIMENT

Figure 1:
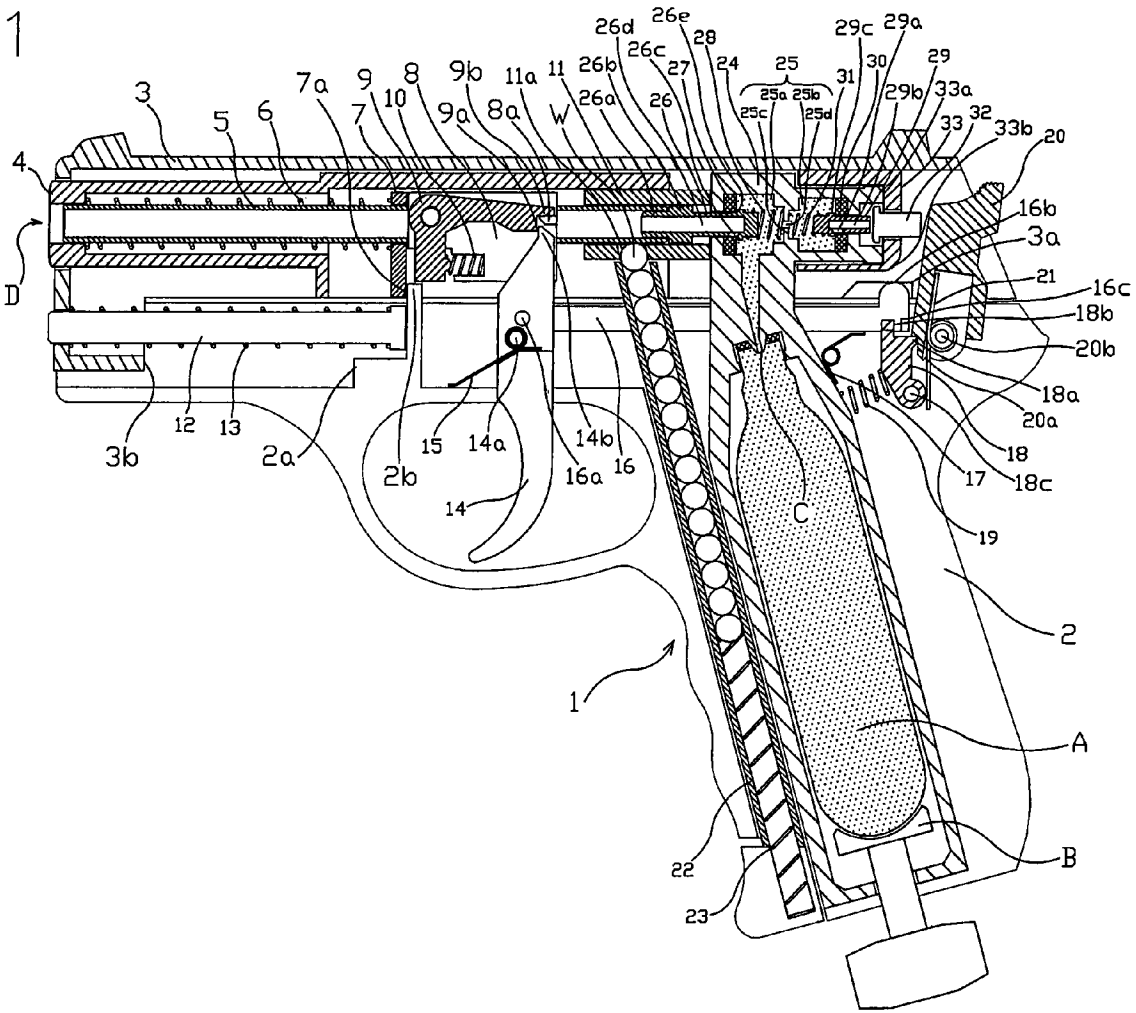
FIG. 1 is an internal explanatory drawing, being a central cross sectional front view, for describing the overall structure of an air gun having the blowback mechanism of one embodiment, representing an embodiment of the present embodiment, showing a state where a magazine in which bullets are inserted and a gas cylinder filled with compressed gas are fitted into the air gun.
Figure 22:
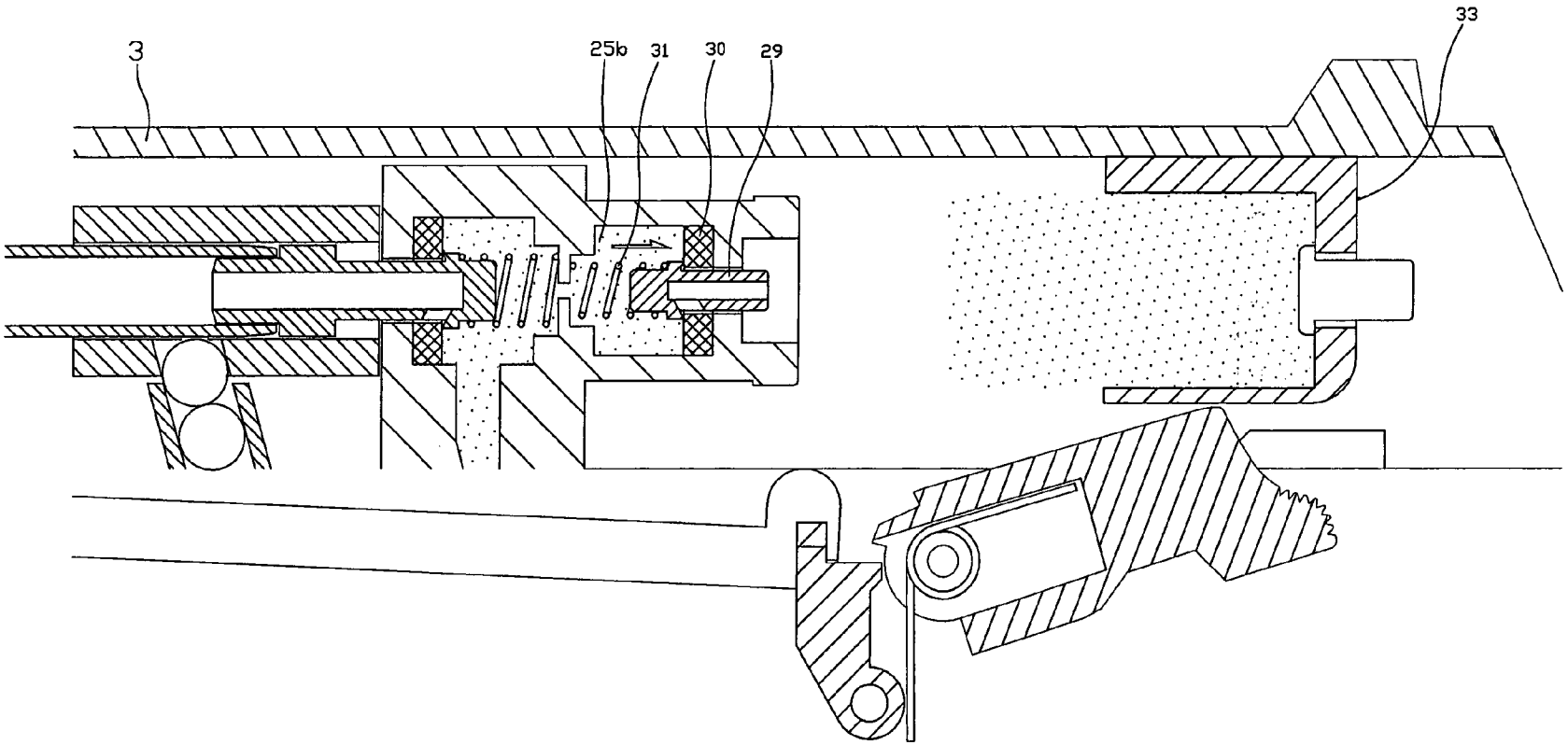
FIG. 22 is an essential enlarged explanatory drawing, being an essential enlarged drawing of FIG. 12, showing operation of the blowback air chamber and the blowback valve.
Figure 23:
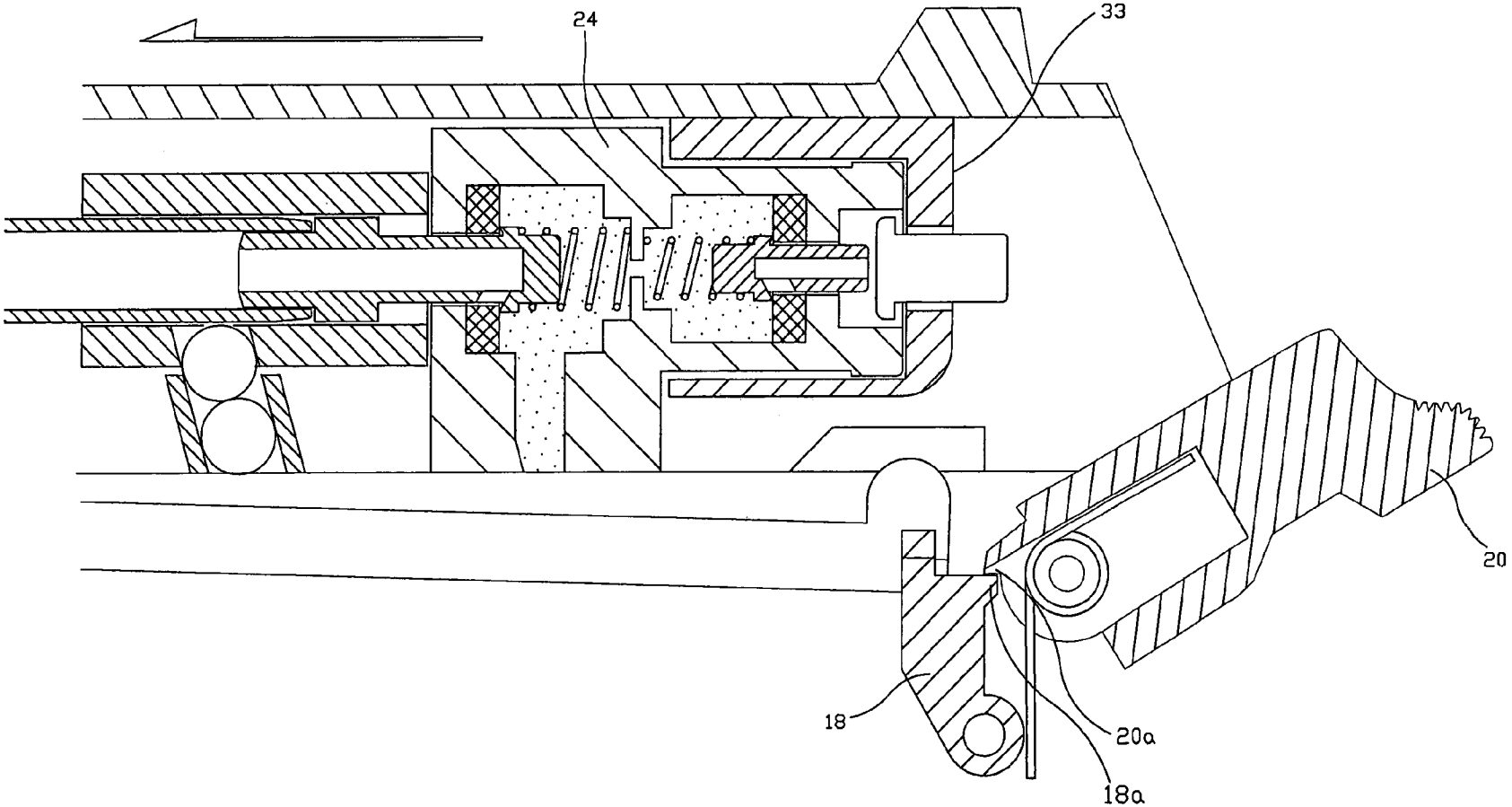
FIG. 23 is an essential enlarged explanatory drawing, being an essential enlarged drawing of FIG. 13, showing operation of the blowback air chamber and the blowback valve.
Figure 25:
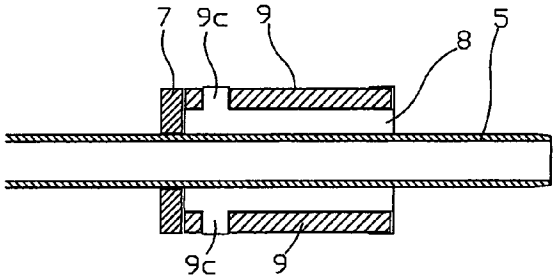
FIG. 25 is an essential enlarged plan cross sectional view, showing a relationship between a barrel housing, and a barrel latch and an inner barrel, of the embodiment of the invention.
Figure 24:
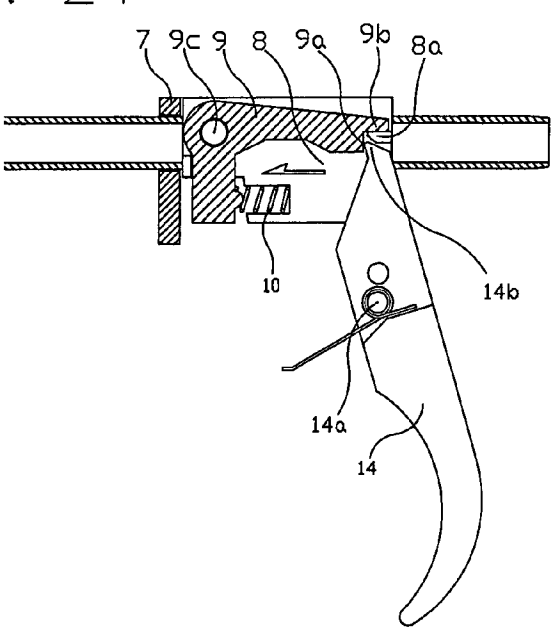
FIG. 24 is an essential enlarged front cross sectional view, showing a relationship between a barrel housing, and a barrel latch and an inner barrel, of the embodiment of the invention.
Figure 26:
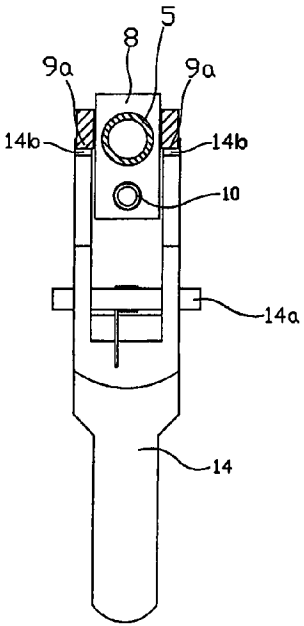
FIG. 26 is an essential enlarged side cross sectional view, showing a relationship between a barrel housing, and a barrel latch and an inner barrel, of the embodiment of the invention.
Figure 29:
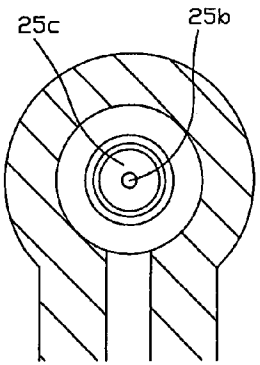
FIG. 29 is a perspective view along arrow XXIX in FIG. 27.
Figure 28:
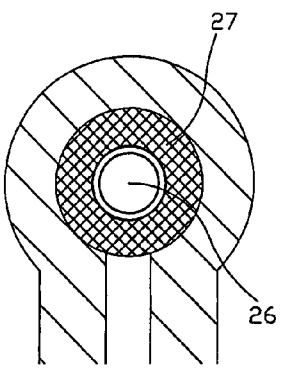
FIG. 28 is a perspective view along arrow XXVIII in FIG. 27.
Figure 27:
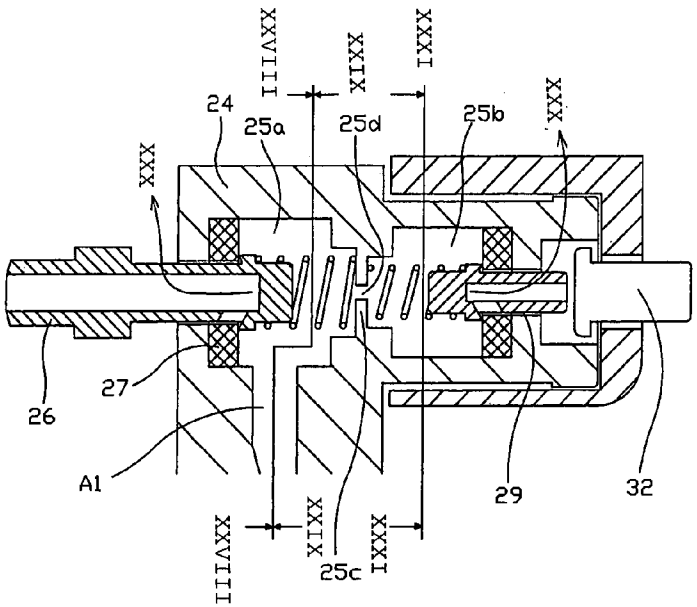
FIG. 27 is an essential enlarged internal front explanatory view of a valve body, being an embodiment of the invention.
Figure 31:
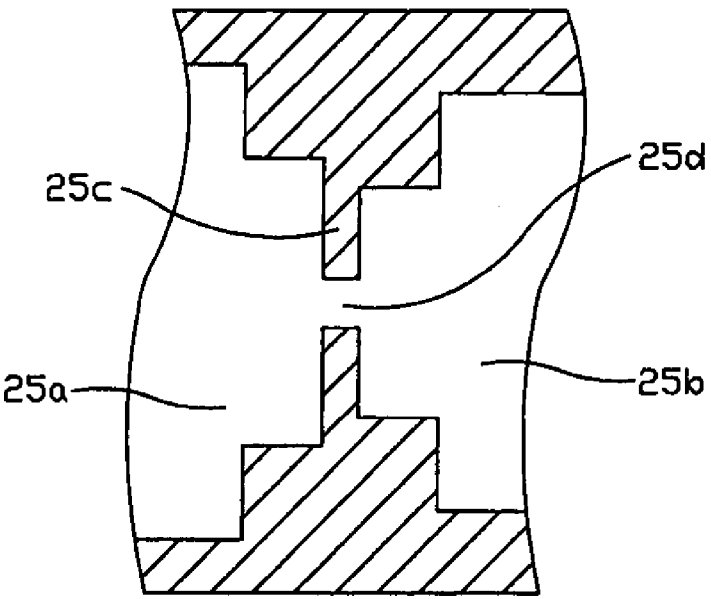
FIG. 31 is a perspective view along arrow XXX1 in FIG. 27, and is a horizontal cross sectional view of through holes.
Figure 30:
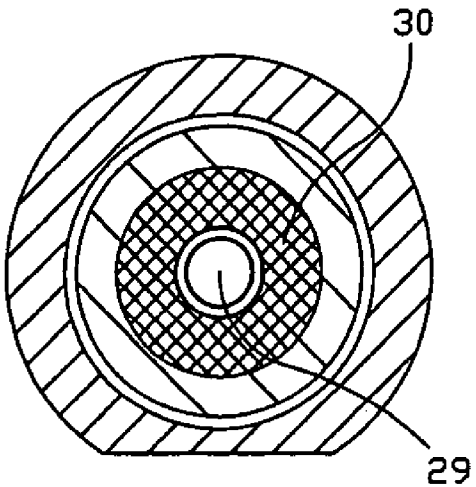
FIG. 30 is a perspective view along arrow XXX in FIG. 27.

An air gun having the blowback mechanism of this invention will now be described based on FIG. 1 to FIG. 26 that show one embodiment. FIG. 1 is an internal explanatory drawing, being a central cross sectional front view for describing the overall structure of an air gun having the blowback mechanism of one embodiment, FIG. 2 to FIG. 14 are internal explanatory drawings, being central cross sectional front views showing operation of one cycle up to bullet firing of the air gun having the blowback mechanism. FIG. 15 to FIG. 18 are essential enlarged drawings of FIG. 5 to FIG. 8, and essential enlarged internal front explanatory drawing showing operation of a bullet firing valve, FIG. 19 to FIG. 23 are essential enlarged view of FIG. 9 to FIG. 13, and essential enlarge internal front explanatory views showing operation of a blowback air chamber and a blowback valve, and FIG. 24 to FIG. 26 are explanatory drawings showing a relationship between a barrel housing and a barrel latch and an inner barrel. FIG. 27 is an essential enlarged internal front explanatory view of a valve body, FIG. 28 is a perspective view along arrow XXVIII in FIG. 27, FIG. 29 is a perspective view along arrow XXIX in FIG. 27, FIG. 30 is a perspective view along arrow XXX in FIG. 27, and FIG. 31 is a perspective view along arrow XXX1 in FIG. 27, and is a horizontal cross sectional view in the vicinity of through holes.

Next, the structure of an air gun having the blowback mechanism of the embodiment of the present invention will be described based on FIG. 1 The air gun of this embodiment of the invention is an automatic type air gun that fires a bullet W using gas pressure of compressed carbon dioxide, and also supplies the next bullet by blowback. With this embodiment, carbon dioxide is used as the compressed gas, but it is also possible to operate using another compressed gas such as compressed nitrogen gas or compressed air. In the following, for this embodiment the compressed carbon dioxide will be referred to as compressed gas. Also, a frame (handle section) 2 is provided at a gun rear end lower part of the air gun body 1. A gas canister A, which is a compressed gas source for supplying compressed gas, is interchangeably housed inside the frame 2. As the compressed gas source, it is also possible to provide a pressurized reservoir inside the frame 2, besides a pressurized canister such as the gas canister A. The gas canister A is inserted from a side surface of the frame 2, and by pressing upwards using a press screw B is opened by a lower tip end of a gas supply port C, that will be described later, and compressed gas is supplied from the gas supply port C. This embodiment is configured so that the gas canister A of compressed gas is housed inside the frame 2, but it is also possible to have a structure where the gas canister is housed outside the frame 2, or where compressed gas is supplied to the air gun body 1 using a hose or the like from a gas canister fitted by the user.

The main structural components of the air gun of this invention are a gun body 1 having a frame 2 (grip section) at a rear part, an inner barrel 5, which is a ballistic path, an outer barrel 4 provided outside the inner barrel 5, a slide 3 capable of sliding parallel to the outer barrel 4, a cylinder 33 fixed to a gun rear end side inner section of the slide 3, a hit pin 32 provided projecting from a hollow inner part of the cylinder 33 to the gun rear side and slidable in the muzzle direction, a hammer 20 capable of pushing the hit pin as a result of operation of a trigger 14, a valve body 24 provided between a chamber 11 and the cylinder 33, a bullet firing air chamber 25*a* and a blowback air chamber 25*b* provided as two hollow sections inside the valve body 24, a bullet firing valve 26 provided in the bullet firing air chamber 25*b*, a blowback valve 29 provided in the blowback air chamber 25*b*, and a barrel latch 9 actuated by the trigger 14. Reference numeral 22 is a magazine, which can be attached and removed to and from the frame 2.

The slide 3 is capable of sliding along the outer barrel 4. This slide 3 is urged to the muzzle side by the tension of a recoil spring 13. The outer barrel 4 and the inner barrel 5 are both cylindrical. The inner barrel 5 is a ballistic path, and is provided at an inner part of the outer barrel 4.

A box-shaped barrel housing 8 having a hollow inner section is provided in the vicinity of a central section, in the longitudinal direction, of the inner barrel, as shown in FIG. 24 to FIG. 26, capable of sliding on an outer surface of the inner barrel 5, and is urged to the rear by a barrel spring 6. A barrel latch 9 is provided on the barrel housing 8 so as to be capable of rotation relative to the barrel housing 8 with the rotation shaft 9C as a center. The barrel latch 9 is provided in the same shape on both sides of the barrel housing 8 and the inner barrel 5.

A barrel spring washer 7 is provided at a muzzle side of the barrel housing 8, and is provided in contact with a gun rear end surface of the barrel spring 6. The barrel spring 6 and the barrel spring washer 7 are provided capable of sliding between a muzzle side tip end of the inner barrel 6 and a muzzle side surface of the barrel housing 8. The barrel spring washer 7 has a lower part formed as a frame engagement section 7*a*, and rearward movement is stopped by the frame engagement section 7*a* coming into contact with a barrel spring washer retreat prevention section 2*b* provided on the frame 2.

The barrel latch 9 has a lower part urged to the muzzle side inside the barrel housing 8 by the barrel latch spring 10, and as a result a gun rear end side is urged downwards from the rotation shaft 9C. A barrel housing engagement section 9*b* formed at a gun rear end side of the barrel latch 9 is engaged by contact with a barrel latch engagement section 8*a* of the barrel housing 8. Also, a trigger contact section 9*a* formed on a gun rear end side of the barrel latch 9 and an upper tip section 14*b* of the trigger 14 have a function of engaging and disengaging with operation of the trigger 14.

The barrel body 24 is fixed to the frame 2, and is provided between the muzzle side chamber 11 and the gun rear side cylinder 33. A bullet firing air chamber 25*a* and a blowback air chamber 25*b*, that are two hollow sections capable of holding compresses gas in an air-tight manner, are provided inside the valve body 24. With this embodiment, the bullet firing air chamber and the blowback air chamber are separated by a separating wall 25*c*, and connected by a microscopic connecting passage 25*d* having a small area compared to the area of the respective hollow sections between the two air chambers. The bullet firing air chamber 25*a* is provided at a nozzle side, while the blowback air chamber 25*b* is provided at a gun rear side.

With the illustrated embodiment disclosed in claim 2, gas inside the gas canister A flows into the bullet firing air chamber 25*a* from a gas passage A1 in the lower part of the valve body 24 due to gas pressure inside the gas canister A, passes through the microscopic passage 25*d* provided in the separating wall 25*c* and also flows to the blowback air chamber 25*b*.

With another not-illustrated embodiment, it is also possible to have a structure where gas inside the gas canister A initially flows to the blowback air chamber 25*b* from a gas passage A1 in the lower part of the valve body 24 due to gas pressure inside the gas canister A, then passes through the microscopic passage 25*d* provided in the separating wall 25*c* and flows to the bullet firing air chamber 25*a*.

With an non-illustrated embodiment as disclosed in claim 3, the bullet firing chamber 25*a* and the blowback chamber 25*b* are constructed as independent hollow sections that are not connected to each other, and respectively have connecting passages A1 connecting to independent gas canisters A.

A through hole is formed in a muzzle side wall surface of the bullet firing air chamber 25*a*, and a bullet firing valve 26 is slidably provided in this through hole. The bullet firing valve 26 is a cylindrical shape with a gun rear end surface closed and a nozzle side end surface open, with the inside of the cylinder being provided as a gas passage 25*d* inside the bullet firing valve, and a firing valve opening section 26*c* provided at a gun rear side lower surface.

The bullet firing valve 26 is urged to the muzzle side by tension of a bullet firing valve spring 28 provided inside the bullet firing air chamber 25*a*, and is provided capable of sliding in the through hole. A bullet firing valve large diameter section 26*b* having a large cylindrical diameter is formed on the outer peripheral surface of the bullet firing valve 26 at a central section in the longitudinal direction. A muzzle side tip end of the bullet firing valve 26 is provided with a bullet firing valve small diameter section 26*a* having a cylindrical diameter that is smaller than the bullet firing valve large diameter section 26*b*. The bullet firing valve small diameter section 26*a* is capable of being fitted into a gun rear end side inner diameter of the inner barrel 5.

A gun rear end side of the bullet firing valve 26 is fitted into the bullet firing air chamber 25*a*, and a large diameter bullet firing valve flange section 26*e* is formed inside the bullet firing air chamber 25*a*. A bullet firing valve packing 27 is attached to a muzzle side wall surface of the bullet firing air chamber 25*a*.

The bullet firing air chamber 25*a* is urged to the muzzle side by tension of the bullet firing valve spring 28, with the bullet firing valve flange section 26*e* pressing the bullet firing valve packing 27 to the muzzle side to effect sealing, and at the same time, in this state, the bullet firing valve opening section 26*c* is sealed by the bullet firing valve packing 27. As a result, the bullet firing air chamber 25*a* is kept air-tight inside.

A through hole is formed in a gun rear end side wall surface of the blowback air chamber 25*b*, and a blowback valve 29 is slidably provided in this through hole. The blowback valve 29 is a cylindrical shape with a gun rear end surface open and a nozzle side end surface closed, with the inside of the cylinder being provided as a gas passage 29*b* inside the blowback valve, and a blowback valve opening section 29*a* is provided at a muzzle end side lower surface.

The blowback valve 29 has a muzzle end section fitted inside the blowback air chamber 25*b*, and a large diameter blowback valve flange section 29*c* is formed at an outer peripheral section of the blowback valve 29. The blowback valve 29 is urged to the gun rear end side by tension of the blowback valve spring 31 provided inside the blowback air chamber 25*b*.

A blowback valve packing 30 is attached to a gun rear end side wall surface of the blowback air chamber 25*b*. The blowback valve flange section 29*c* is pressed to the gun rear end side by the urging force of the blowback valve spring 31, and brought into close contact with the blowback valve packing 30, and at the same time, in this state the blowback valve opening section 29*a* is made airtight by the blowback valve packing 30. As a result, the blowback air chamber 25*b* is kept air-tight inside.

A rear end section of the blowback valve 29 is provided either separated from or in contact with a position where it can contact the hit pin 32.

The cylinder 33 is provided capable of sliding integrally with the slide 3. The cylinder 33 is cylindrical, with a rear side wall 330 provided at a gun rear end side, and an inner side wall of the cylinder 33 is constructed as a cylinder pressure surface 33*a*. A pin hole 331 is provided on the rear side wall 330, and a hit pin 32 is provided capable of sliding in the pin hole 331. A rear section of the valve body 24 is fitted inside the cylinder 33.

When the bullet firing valve 26 is slid to the gun rear end side against the urging of the bullet firing valve spring 28, the bullet firing valve opening section 26*c* formed in the bullet firing valve 26 is opened and it becomes possible for gas that has been filled into the bullet firing air chamber 25*a* from the gas canister A to flow from the opening section through the gas passage 26*d* inside the bullet firing valve to the inside of the inner barrel 5.

Also, when the blowback valve 29 is slid to the muzzle side against the urging of the blowback valve spring 31, the blowback valve opening section formed in the blowback valve 29 is opened, gas that has been filled into the blowback air chamber 25*b* flows from the opening section through the gas passage 29*b* inside the blowback valve 29 to the inner gap of the cylinder 33, and it becomes possible for the cylinder pressure surface 33*a*, which is a gun rear end side inner surface of the cylinder 33, to be pushed.

The hammer 20 is urged to the muzzle side by the hammer spring 21, and is positioned inside the gun body 1 so as to be capable of rotation about the hammer rotation shaft 20*b* as a rotational center. A shear locking section 20*a* is provided on the hammer 20, and it is possible to lock the hammer 20 in a state rotated to the gun rear end side.

A shear 18 is urged to the gun rear end side by the shear spring 19, and is provided inside the gun body 1 so as to be capable of rotation about a shear rotation shaft 18*c* as a rotational center. A hammer locking section 18*a* is provided for locking the hammer 20 in the rotated state when the hammer 20 is rotated to the gun rear end side. A trigger engagement lug section 18*b* capable of engaging with a shear engagement lug section 16*c* of the trigger 16 is provided on an upper end of the shear 18.

The trigger 14 is provided in the gun body 1 capable of rotation about the trigger shaft 14*a* as a center of rotation. The trigger shaft 16*a* is fitted into the trigger 14, and a trigger bar 16 is linked to the trigger 14. The trigger 14 is constructed so that an upper end thereof is urged to the gun rear end side by a trigger spring 15. The trigger bar 16 is positioned so that the rear is capable of rotation about the trigger bar shaft 16*a* as a center of rotation, and is urged upwards by a trigger bar spring 17.

A magazine 22 is case-shaped, and removably provided inside the frame 2. A plurality of bullets W are loaded inside the magazine 22. A magazine spring 23 is provided inside the magazine 22, and the bullets W are constantly urged upwards by this magazine spring 23. If the magazine 22 is fitted into the frame 2, a bullet W comes into contact with a rear end peripheral lower surface part of the inner barrel 5 and is locked. If the inner barrel 5 is moved to the muzzle side, the bullet W is moved upwards by the urging of the magazine spring 23 and placed inside the chamber 11.

The chamber 11 is cylindrical, positioned at the muzzle side of the valve body 24, and has a rear end surface that contacts the muzzle side surface of the valve body 24, with the inner barrel 5 and the bullet firing valve 26 respectively fitted inside the cylinder of the chamber 11 capable of sliding.

Next, operation of one cycle up to bullet firing of the air gun having the blow back mechanism that is one embodiment of the present invention will be described based on FIG. 2 to FIG. 14, which are internal front explanatory views, FIG. 15 to FIG. 18, which are essential enlarged internal front explanatory views showing the bullet firing air chamber and operation of the bullet firing valve, FIG. 19 to FIG. 23, which are essential enlarged internal explanatory views showing the blowback air chamber and operation of the blowback valve, and FIG. 24 to FIG. 26 showing the barrel housing and a relationship between the barrel latch and the inner barrel.

Figure 2:
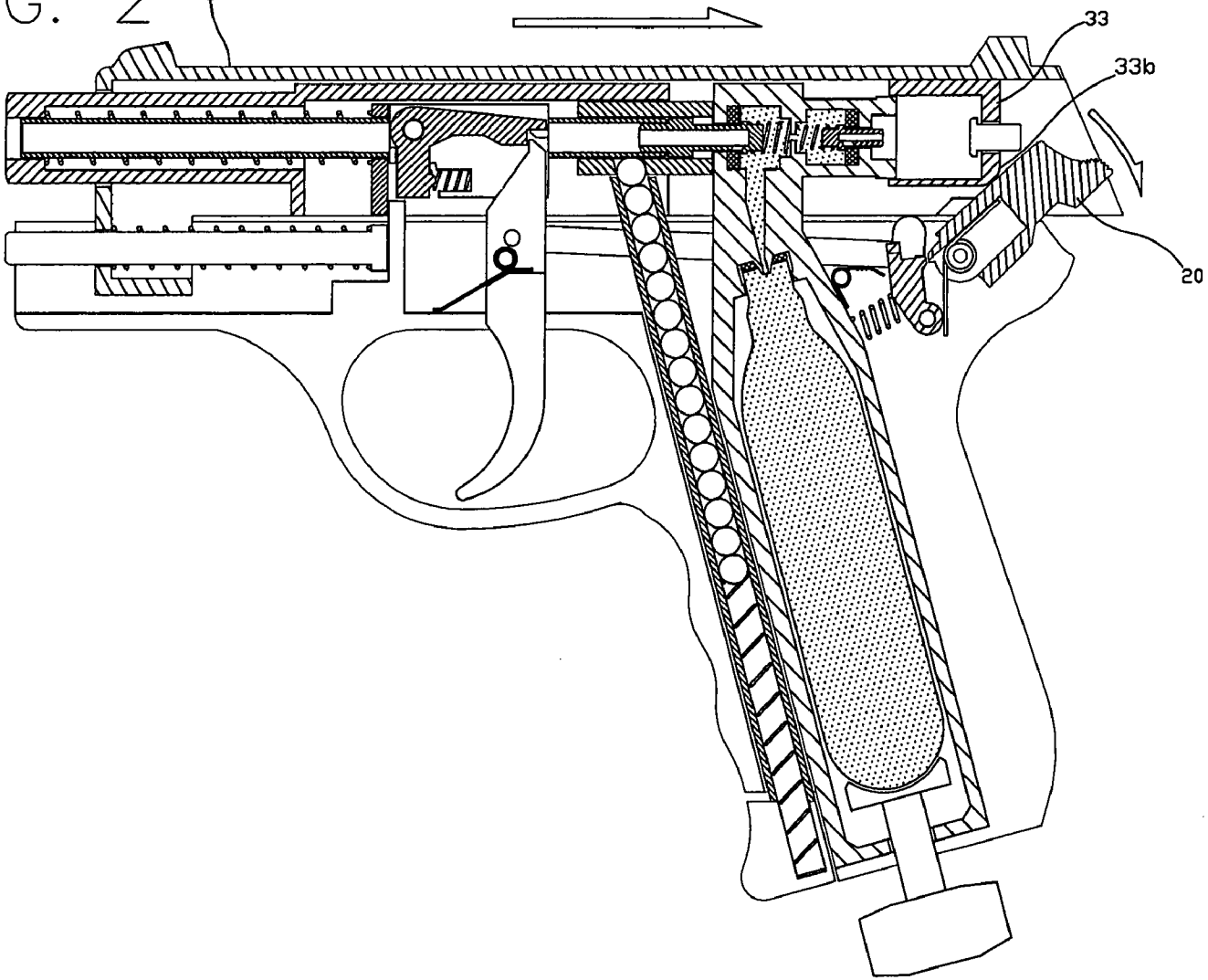
FIG. 2 is a central cross sectional front view showing operation of an air gun having a blowback function of an embodiment of the invention, and showing a state immediately after the user starts to slide a slide to the gun rear side with their hand.
Figure 3:
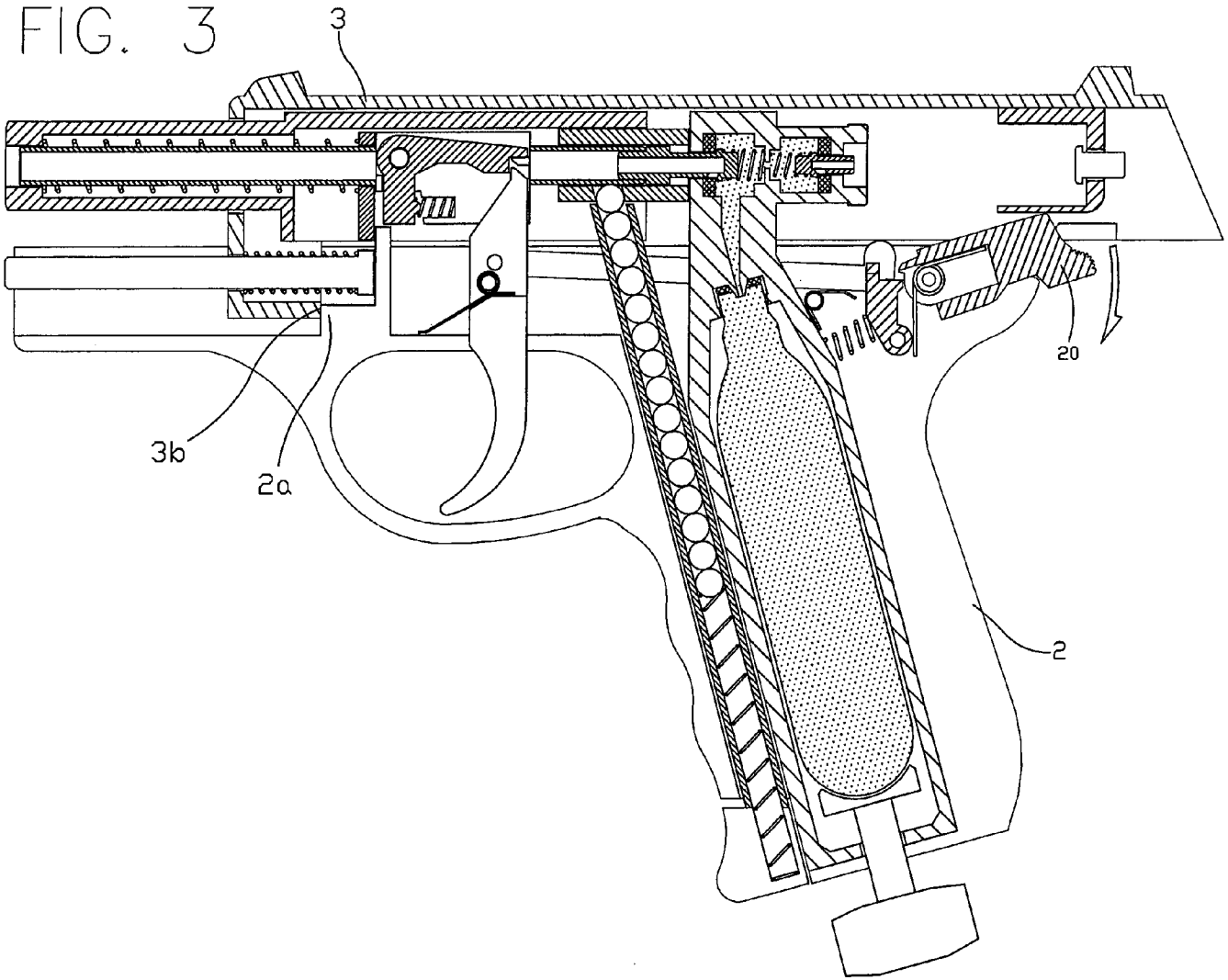
FIG. 3 is an internal explanatory drawing, being a ventral cross sectional front view showing a state where the slide is slid further to the gun rear end side by the users hand, after the state of FIG. 2.

FIG. 2 and FIG. 3 show a state when the user slides the slide 3 to the gun rear end side with their hand. When the slide 3 is slid to the gun rear end side, the cylinder 33 that is integrally provided in the slide 3 is also lowered to the gun rear end side. If this is done, the hammer 20 comes into contact with the rear lower surface 33*b* of the cylinder 33, and starts rotating towards the gun rear end side about the hammer rotation shaft 20*b*.

If the slide 3 is manually slid further towards the gun rear end side, the hammer 20 again rotates further towards the gun rear end side. A slide backward movement prevention section 2*a* is provided in the frame 2. Movement of the slide 3 towards the gun rear end side is stopped by the muzzle side lower tip section 3*b* of the slide 3 coming into contact with this side backward movement prevention section 2*a* (refer to FIG. 3).

Figure 4:
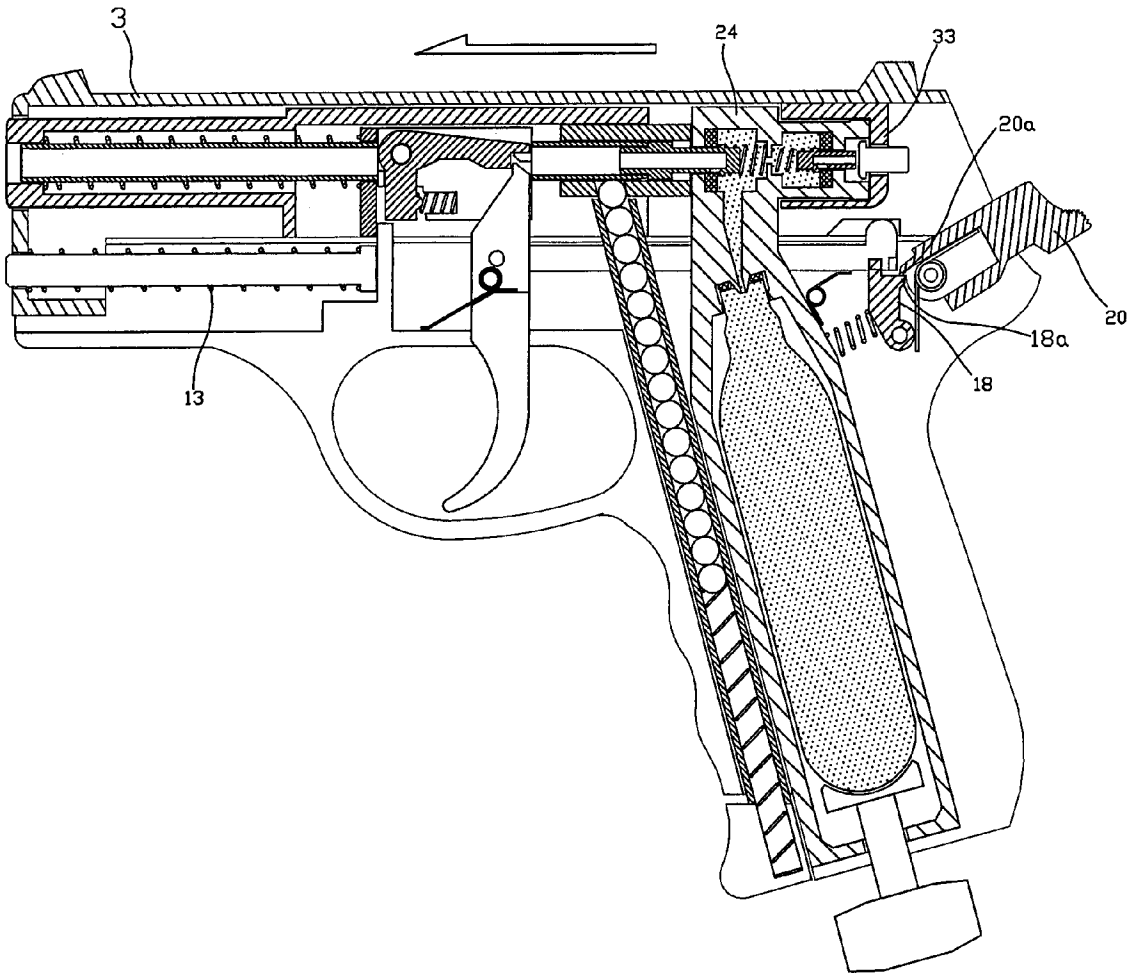
FIG. 4 is an internal explanatory drawing, being a central cross sectional front view, showing a state where a slide is moved forward by urging of a spring and the slide has returned to the position of FIG. 1, after the state of FIG. 3 and after the user's hand has been taken of the slide that has been slid manually to the gun rear end side.

FIG. 4 will now be explained. If the backwardly moved slide 3 is manually separated from the hand, the slide 3 moves to the muzzle side under tension of the recoil spring 13. The cylinder 33 also moves to the rear together with the slide 3, and moves to the muzzle side together with the slide 3. This movement of the slide causes a rear section of the valve body 24 to be inserted into the cylinder 33, and is stopped by contact between a gun rear end side wall surface inside the cylinder 33 and a gun rear end side wall surface of the valve body 24.

The hammer 20 starts rotating toward the muzzle side due to the urging of the hammer spring 21, but the shear locking section 20*a* of the hammer 20 comes into contact with the hammer locking section 18*a* of the shear 18 to stop the rotation of the hammer 20, and the hammer and the shear are locked.

Since the objective is to cause the hammer 20 to rotate and engage with the shear 18, it is also possible to arrive at an initial state for bullet firing shown in FIG. 2 to FIG. 4 where the hammer 20 itself is pushed downwards by the user's hand to cause the hammer 20 and the shear 18 to engage, even if the side 3 is not slid back by the user.? (hard to see why the drawings are mentioned here)

Next, FIG. 5 and FIG. 15 will be described. The trigger 14 is manually pulled to the gun rear end side. If this is done, the trigger 14 rotates about the trigger shaft 14*a*, and an upper tip end section 14*b* of the trigger 14 contacts and presses a trigger contact section 9*a* of the barrel latch 9. Together with this action, the barrel housing 8 pushes the barrel spring washer 7 to the muzzle side. The barrel spring washer 7 compresses the barrel spring 6 while moving to the muzzle side. At the same time, the inner barrel 5 and the barrel housing 8 also move to the muzzle side.

Figure 6:
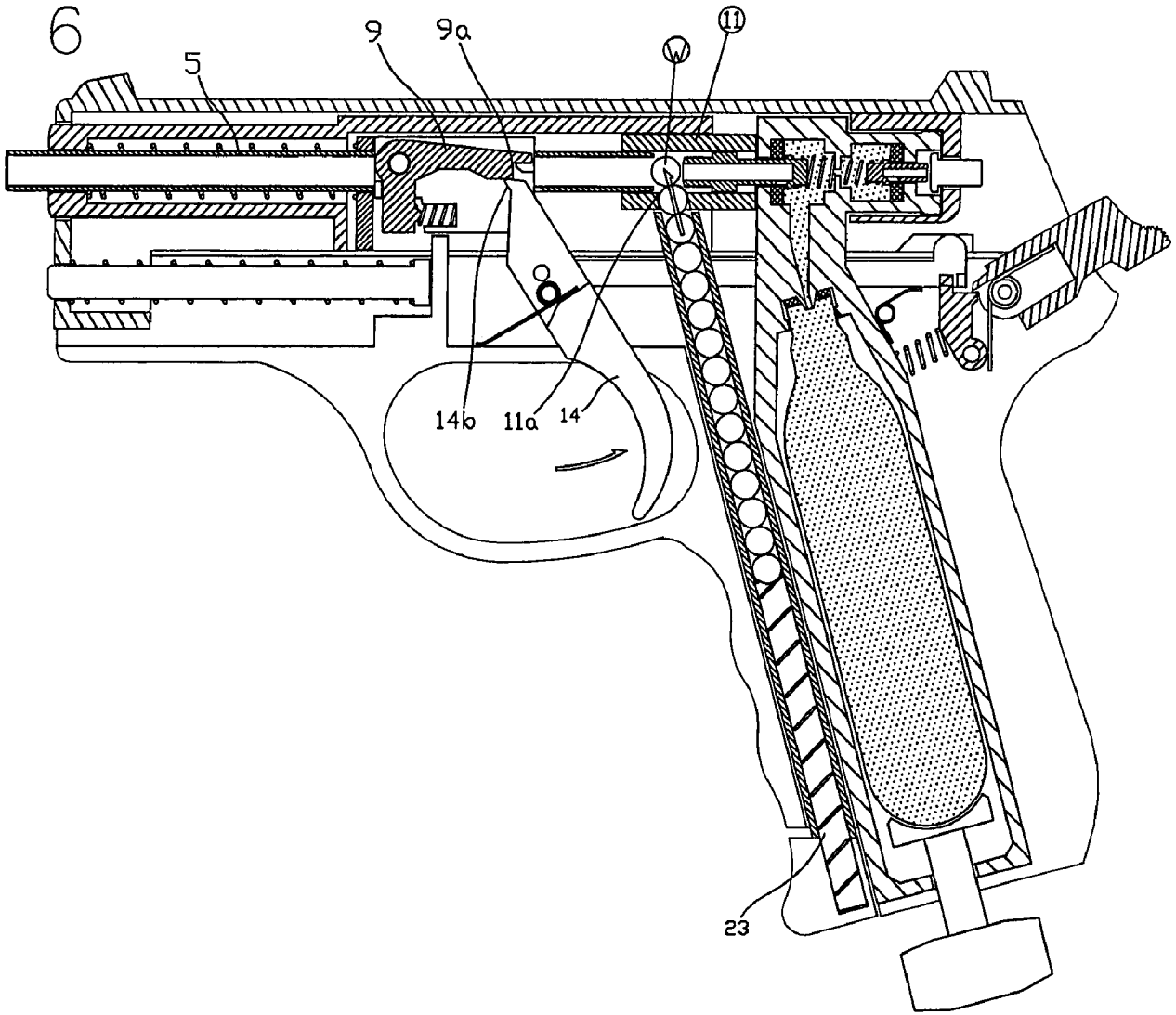
FIG. 6 is an internal explanatory drawing, being a central cross sectional front view, showing a state where the trigger is pulled further back and the inner barrel has moved forward, after the state of FIG. 5.
Figure 16:
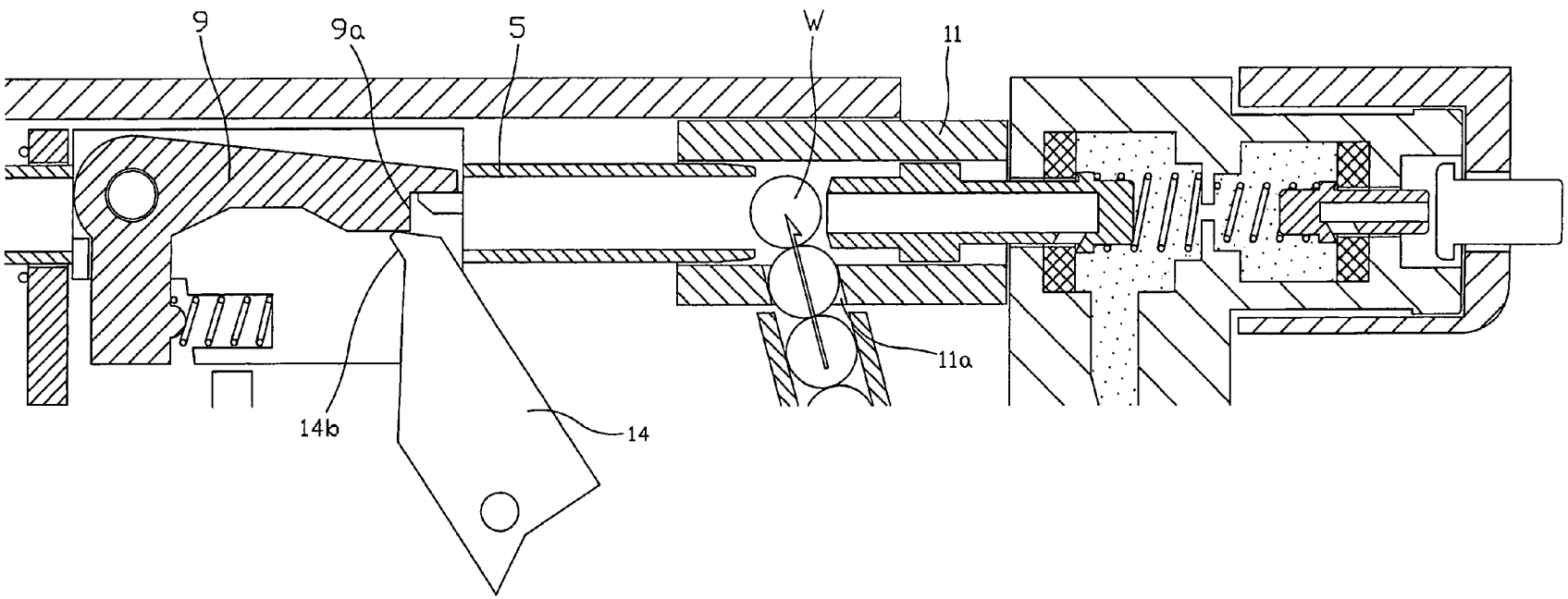
FIG. 16 is an essential enlarged explanatory drawing, being an essential enlarged drawing of FIG. 6, showing operation of the firing air chamber and the bullet firing valve.

Next, FIG. 6 and FIG. 16 will be described. If the trigger 14 is pulled further to the gun rear end side, an upper tip end section of the trigger 14 moves away from the trigger contact section 9*a* of the barrel latch 9, and contact between the trigger 14 and the barrel latch 9 is released.

Figure 5:
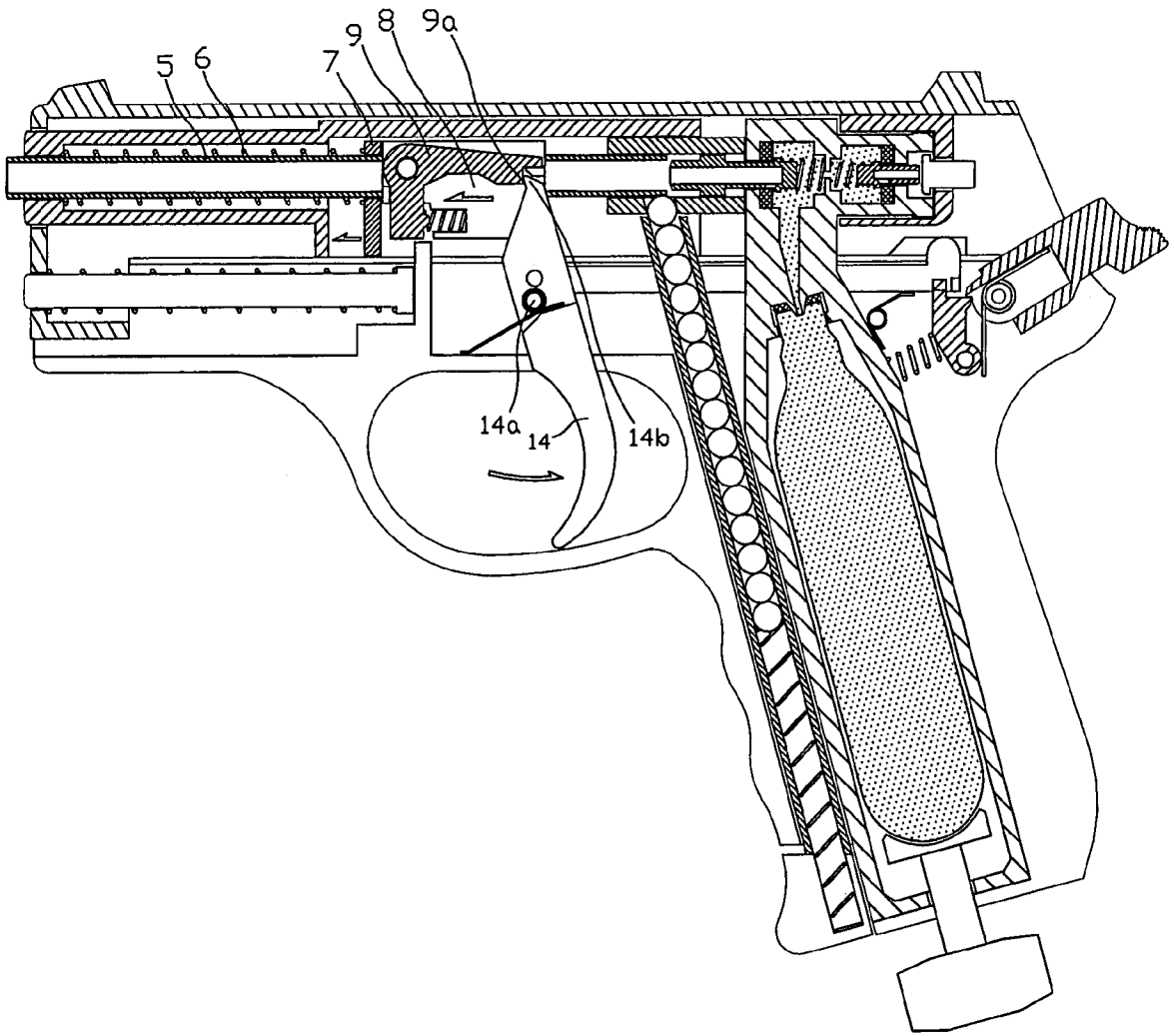
FIG. 5 is an internal explanatory drawing, being a central cross sectional front view, showing a state where an inner barrel starts to move forward due to the trigger starting to draw back, after the state of FIG. 4.
Figure 15:
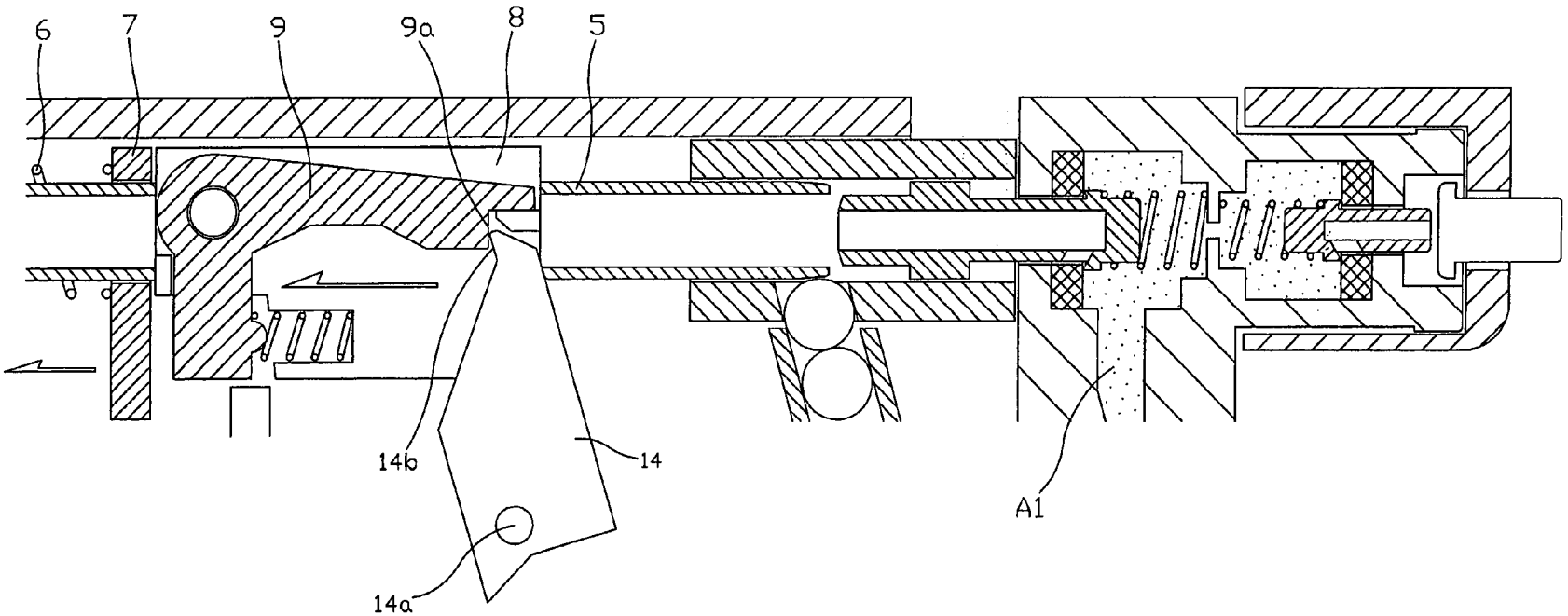
FIG. 15 is an essential enlarged explanatory drawing, being an essential enlarged drawing of FIG. 5, showing operation of the firing air chamber and the bullet firing valve.

In the state shown in FIG. 5 and FIG. 15, the bullets W are being urged upward by the magazine spring 23 inside the magazine 22, but they contact the rear end outer peripheral surface of the inner barrel 5 and can not move inside the chamber 11. Once entering the state of FIG. 6 and FIG. 16, a lower surface opening section 11*a* of the chamber 11 is opened up by movement of the inner barrel to the muzzle side, and a bullet W is fitted into and loaded inside the chamber 11 from the lower surface opening section 11*a*.

Figure 7:
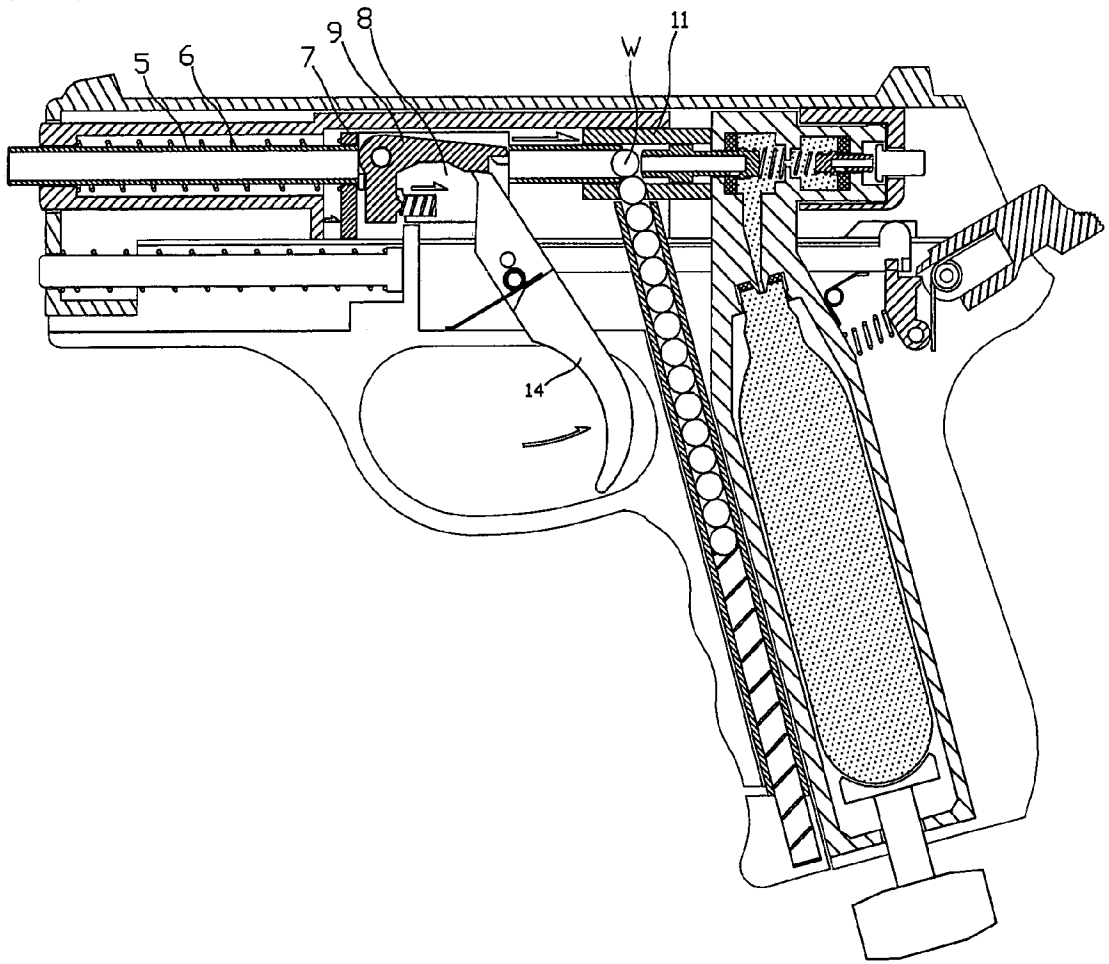
FIG. 7 is an internal explanatory drawing, being a central cross sectional front view, showing a state where an inner barrel starts to move backwards after the trigger has been pulled, after the state of FIG. 6.
Figure 17:
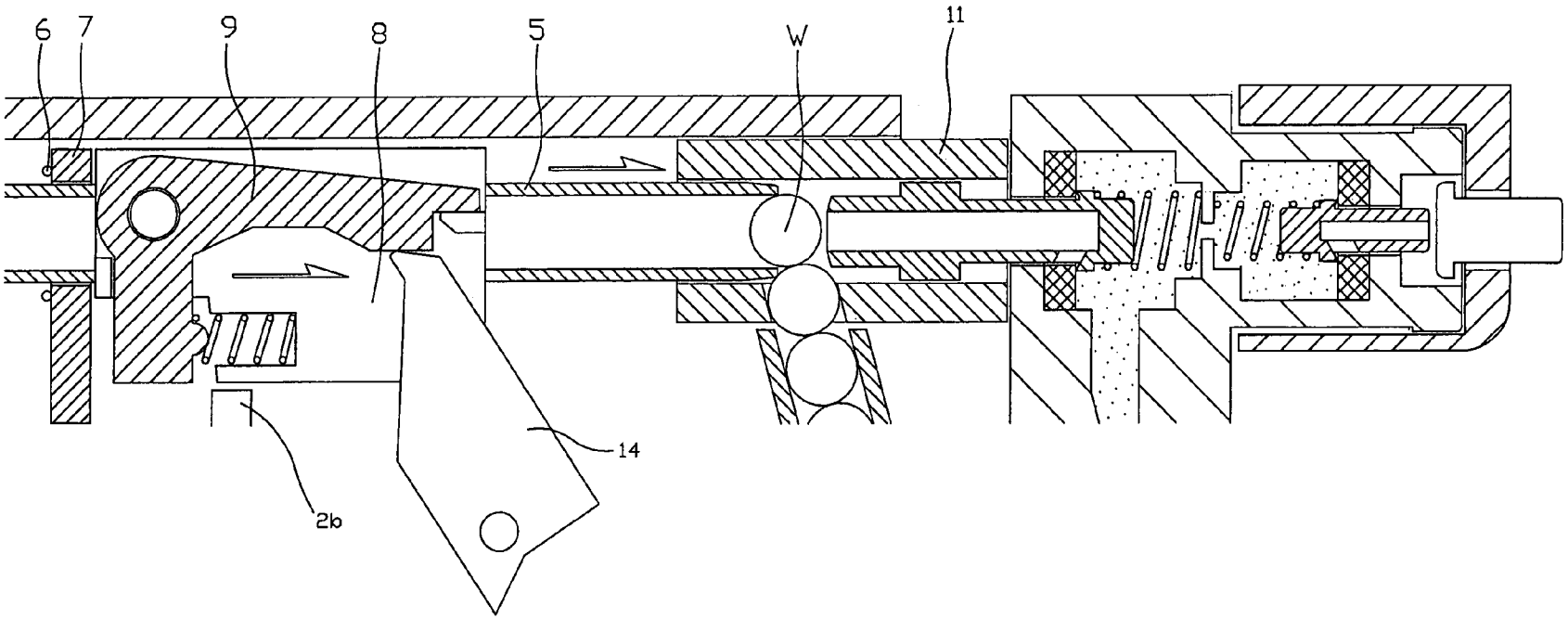
FIG. 17 is an essential enlarged explanatory drawing, being an essential enlarged drawing of FIG. 7, showing operation of the firing air chamber and the bullet firing valve.

Next, FIG. 7 and FIG. 17 will be described. As a result of the contact between the trigger 14 and the barrel latch 9 being released, the barrel spring 6 moves, under its own urging force, to push the barrel spring washer 7 to the gun rear end side. Urging force of the barrel spring 6 causes the inner barrel 5 and the barrel housing 8 to move integrally to the gun rear end side by means of the barrel spring washer 7. If the inner barrel 5 is moved further to the gun rear end side, a bullet W loaded inside the chamber 11 is inserted into the bore from a gun rear end of the inner barrel 5. At the same time, the next bullet W inside the magazine 22 contacts the rear end outer peripheral surface of the inner barrel 5 and stops.

Figure 8:
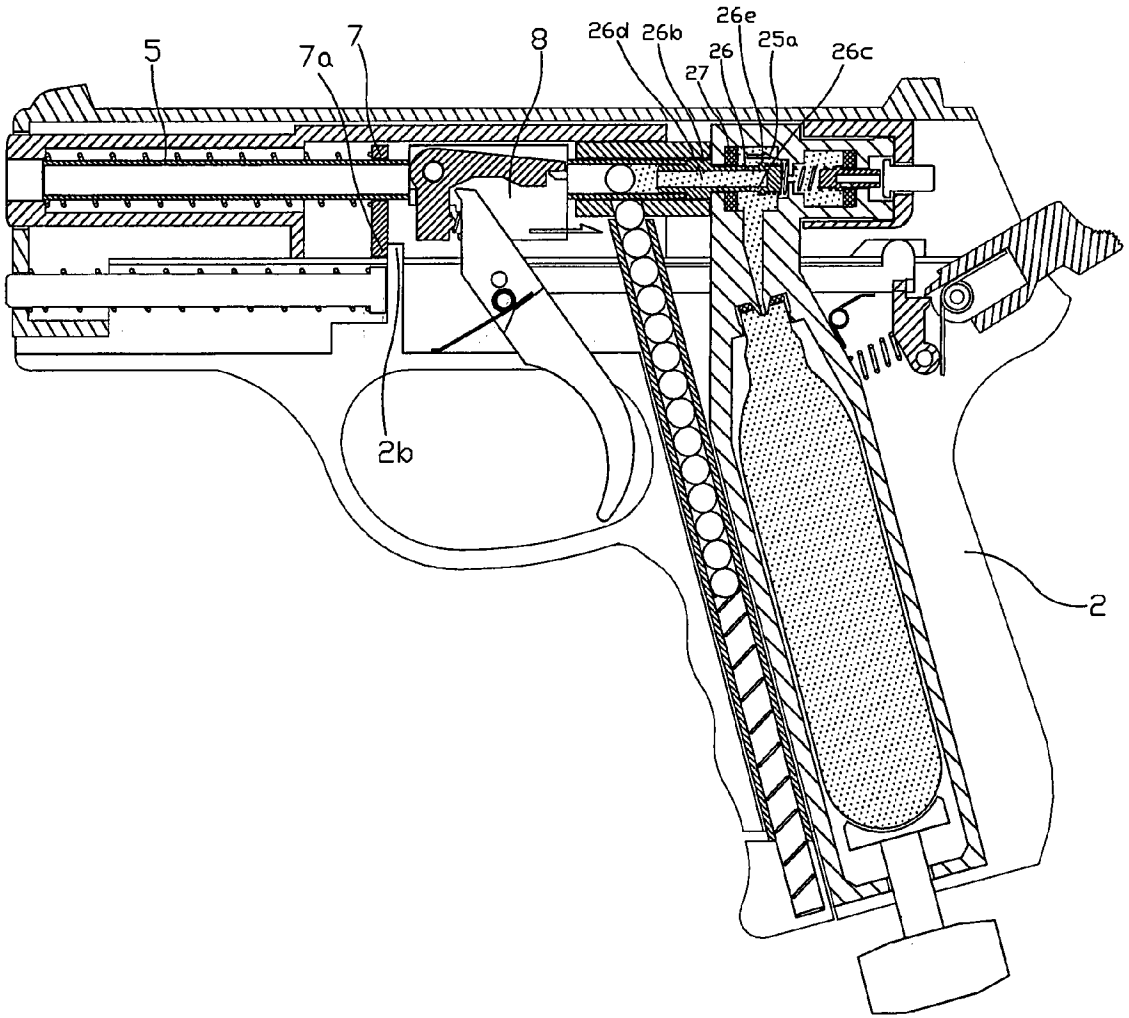
FIG. 8 is an internal explanatory drawing, being a central cross sectional front view, showing a state immediately after the inner barrel moves further back and presses a bullet firing valve, after the state of FIG. 7.
Figure 18:
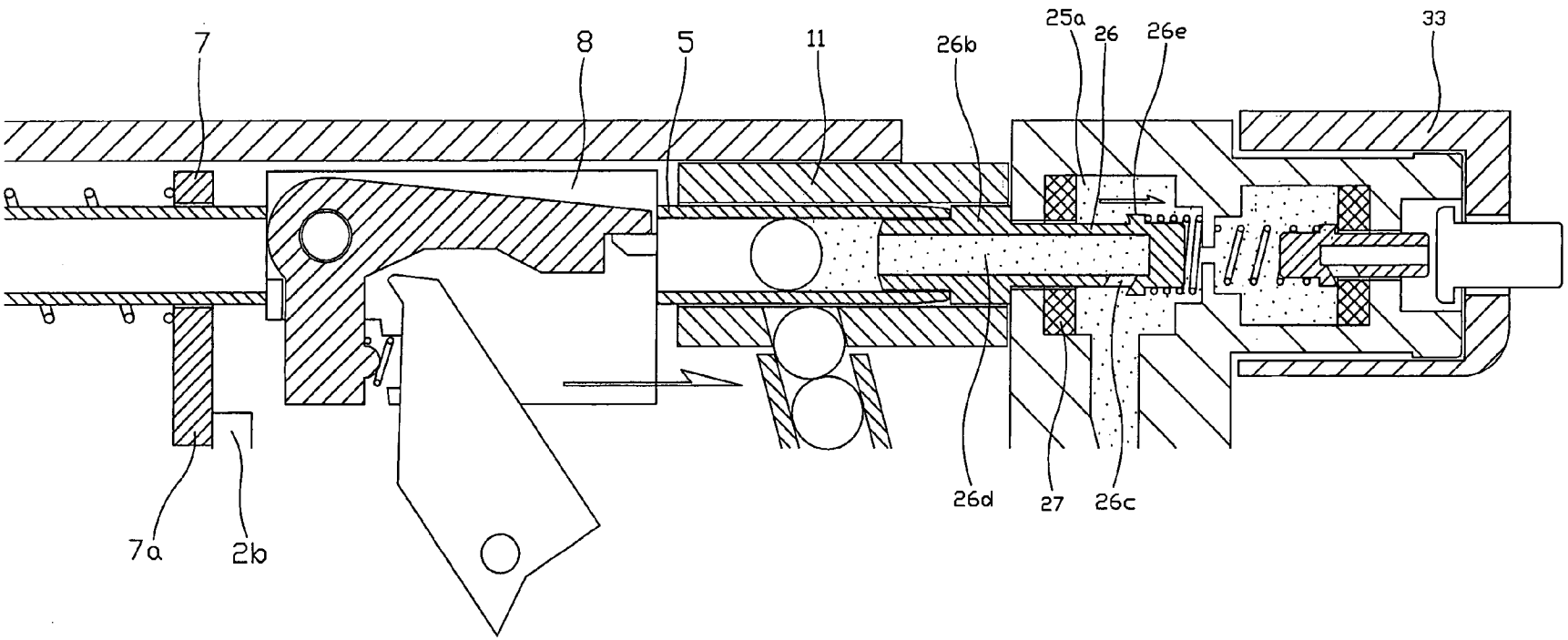
FIG. 18 is an essential enlarged explanatory drawing, being an essential enlarged drawing of FIG. 8, showing operation of the firing air chamber and the bullet firing valve.

Next, FIG. 8 and FIG. 18 will be described. From the state of FIG. 7 and FIG. 17, by moving the inner barrel 5 further to the gun rear end side, the barrel spring washer 7 has rearward movement towards the gun rear end side stopped by a frame engagement section 7*a* formed on a lower part of the barrel spring washer 7 coming into contact with a barrel spring washer rearward movement prevention section 2*b* formed inside the frame 2. Regardless of rearward movement prevention of the barrel spring washer 7, the inner barrel 5 and the barrel housing 8 continue to move to the gun rear end side because of inertial force of movement due to their own weight, and so the barrel spring washer 7 and the barrel housing 8 move apart.

The gun rear end side tip of the inner barrel 5 that continues to move further to the rear due to inertial force enters between an outer peripheral surface of the bullet firing valve 26 and an inner peripheral surface of the chamber 11, moves further to the rear coming into contact with the bullet firing valve large diameter section 26*b*, and pushes the firing valve 26 to the gun rear end side against the urging force of the firing valve spring 28. As a result of this pushing, the bullet firing valve 26 slides to the gun rear end side. As a result of this rearward movement of the bullet firing valve 26, the bullet firing valve opening section 26*c* that was closed by the bullet firing valve packing 27 is opened.

As a result of the bullet firing valve opening section 26*c* opening, gas that was filled into the bullet firing air chamber 25*a* flows through the firing valve opening section 26*c* formed in the gun rear end side tip of the bullet firing valve 26 and enters the gas passage 26*d* inside the bullet firing valve, and flows from the muzzle side opening section of the bullet firing valve 26 into the gun rear end side of the inner barrel 5.

Figure 9:
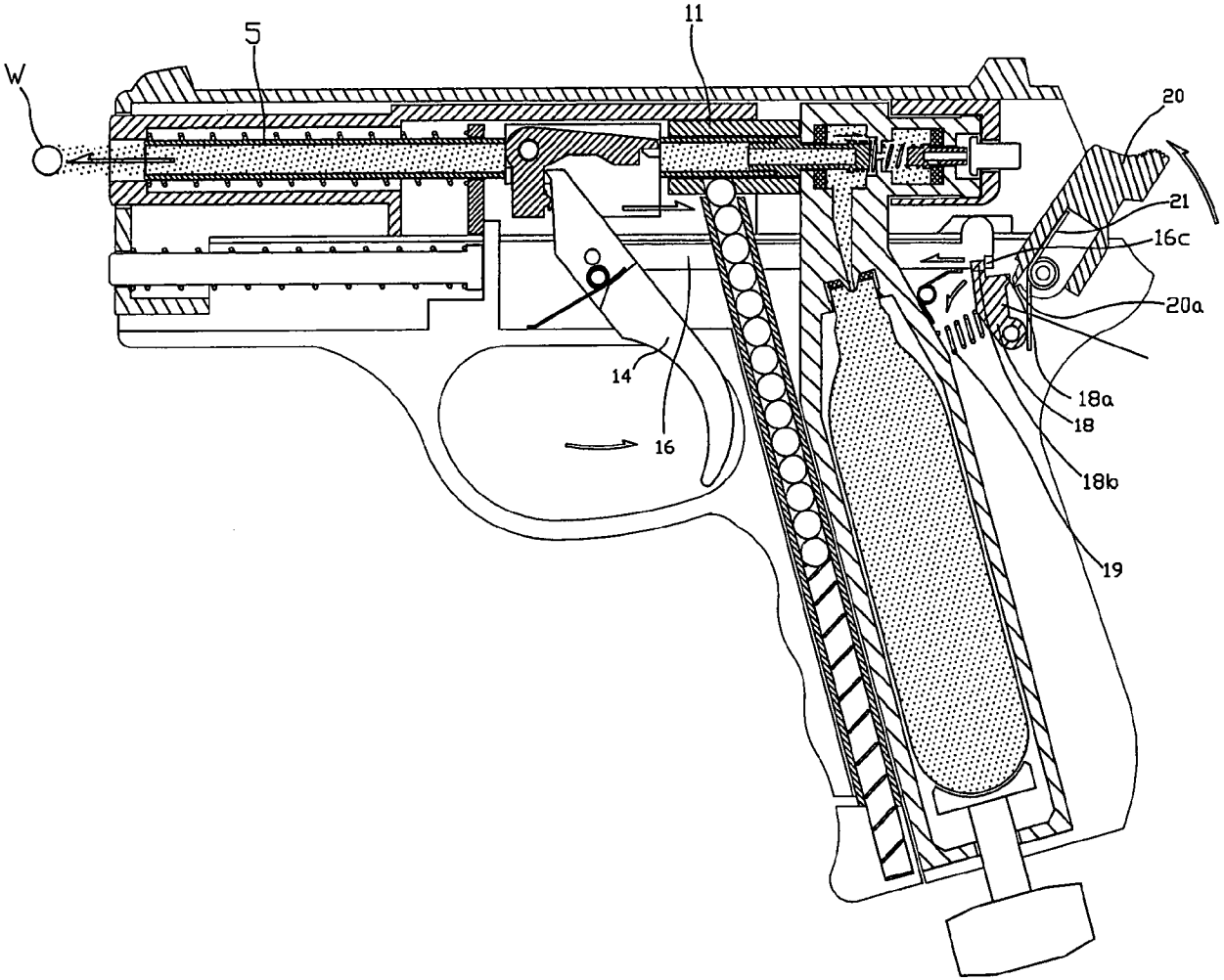
FIG. 9 is an internal explanatory drawing, being a central cross sectional front view, showing a state immediately after a bullet is fired and a hammer starts to rotate, after the state of FIG. 8.
Figure 19:
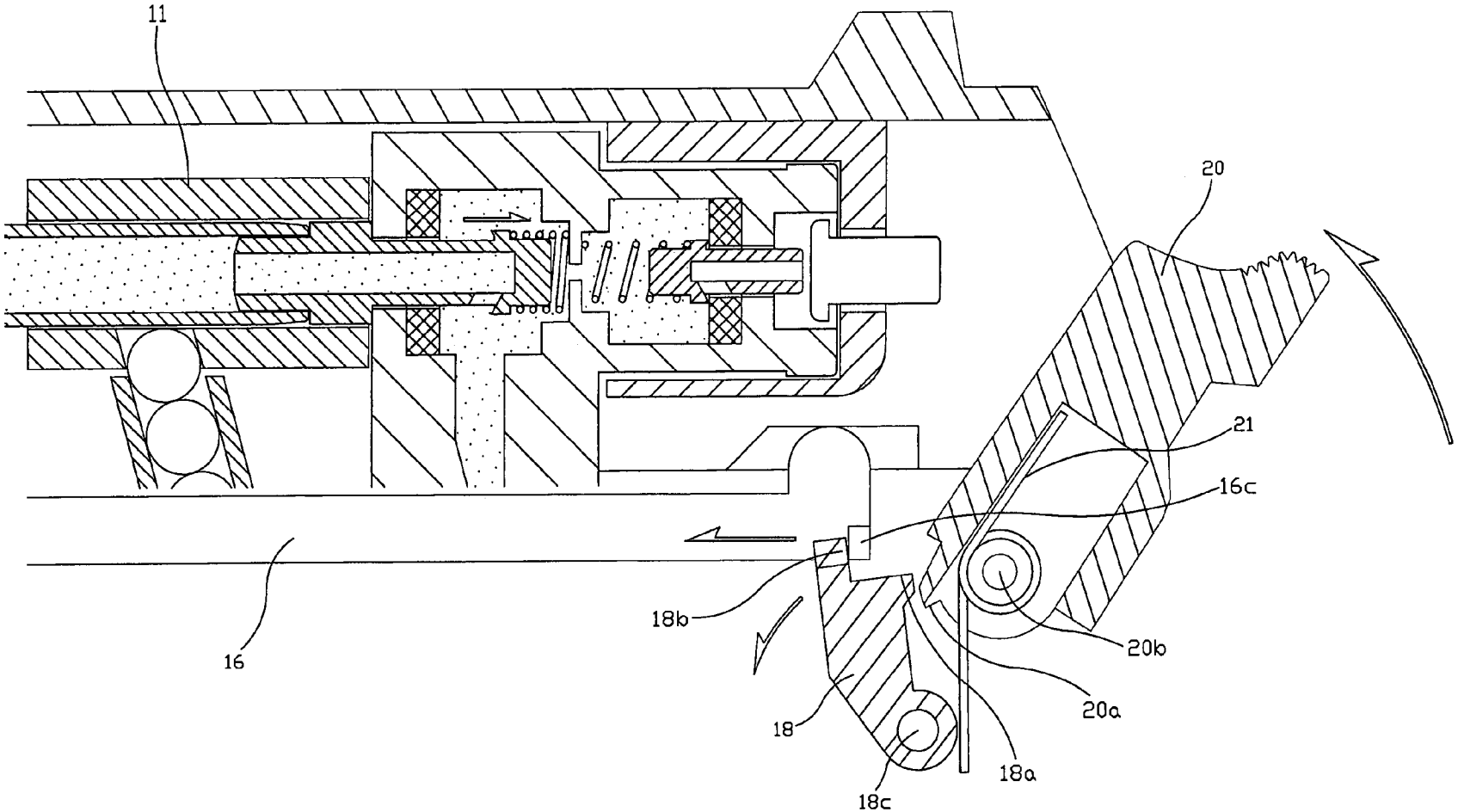
FIG. 19 is an essential enlarged explanatory drawing, being an essential enlarged drawing of FIG. 9, showing operation of the blowback air chamber and the blowback valve.

Next, FIG. 9 and FIG. 19 will be described. The bullet W is fired by gas pressure of gas that has flowed into the gun rear end of the inner barrel that is inserted into the chamber 11. If the trigger 14 is pulled further to the rear, as shown in FIG. 9, the trigger bar 16 that is linked to the trigger 14 moves forward. If this happens, a shear engagement lug section 16*c* provided on the trigger bar 16 moves forward, and comes into contact with a trigger bar engagement lug section 18*b* of the shear 18. As a result of this, the shear 18 rotates to the muzzle side about the shear shaft 18*c* as a center of rotation, while overcoming the urging force of the shear spring 19. As a result the hammer engagement section 18*a* of the shear 18 is inclined to the muzzle side, and therefore engagement between the hammer engagement section 18*a* of the shear 18 and the shear engagement section 20*a* of the hammer 20 is removed, and the hammer 20 starts to rotate in an anti-clockwise direction due to the urging force of the hammer spring 21.

Figure 10:
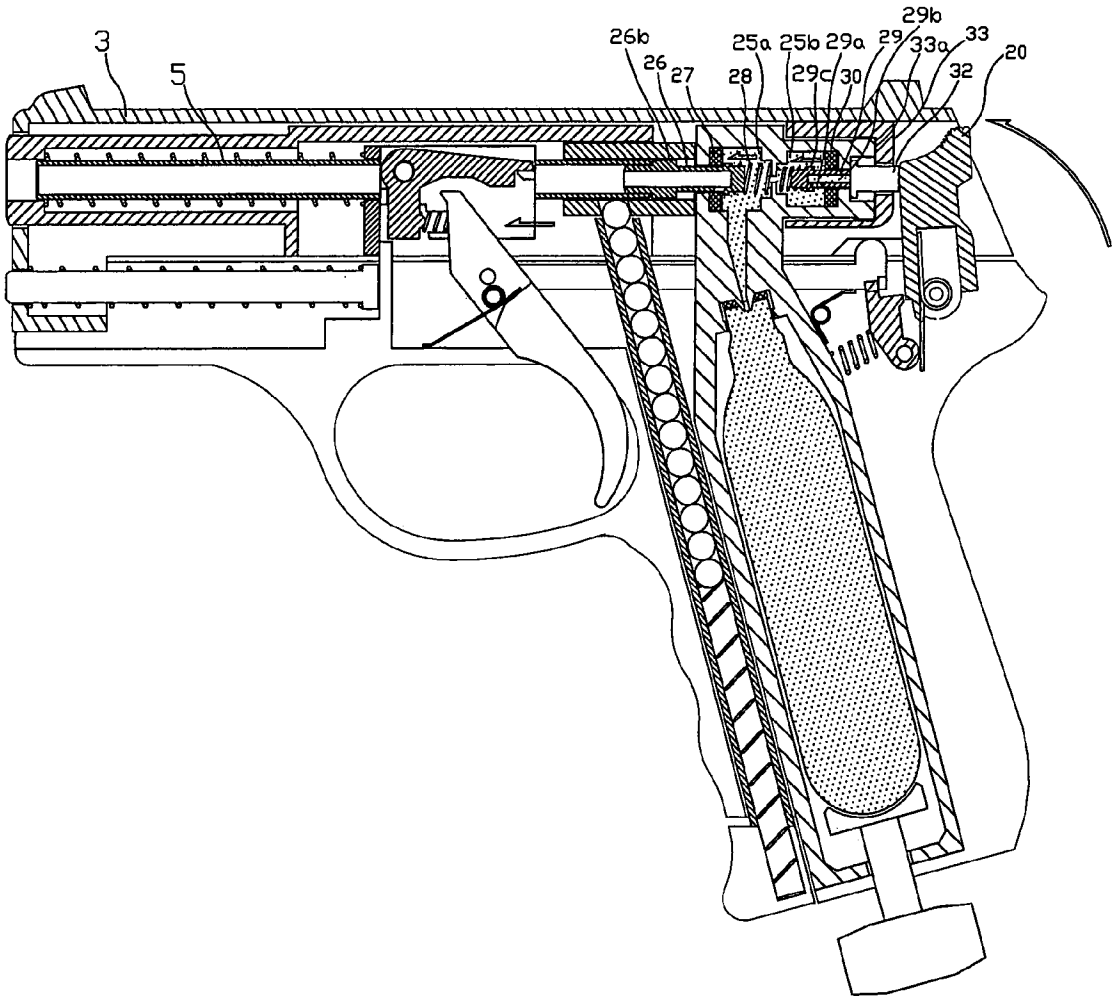
FIG. 10 is an internal explanatory drawing, being a central cross sectional front view, showing a state immediately after a bullet firing valve is closed and a blowback valve is presses by a hammer, after the state of FIG. 9.
Figure 20:
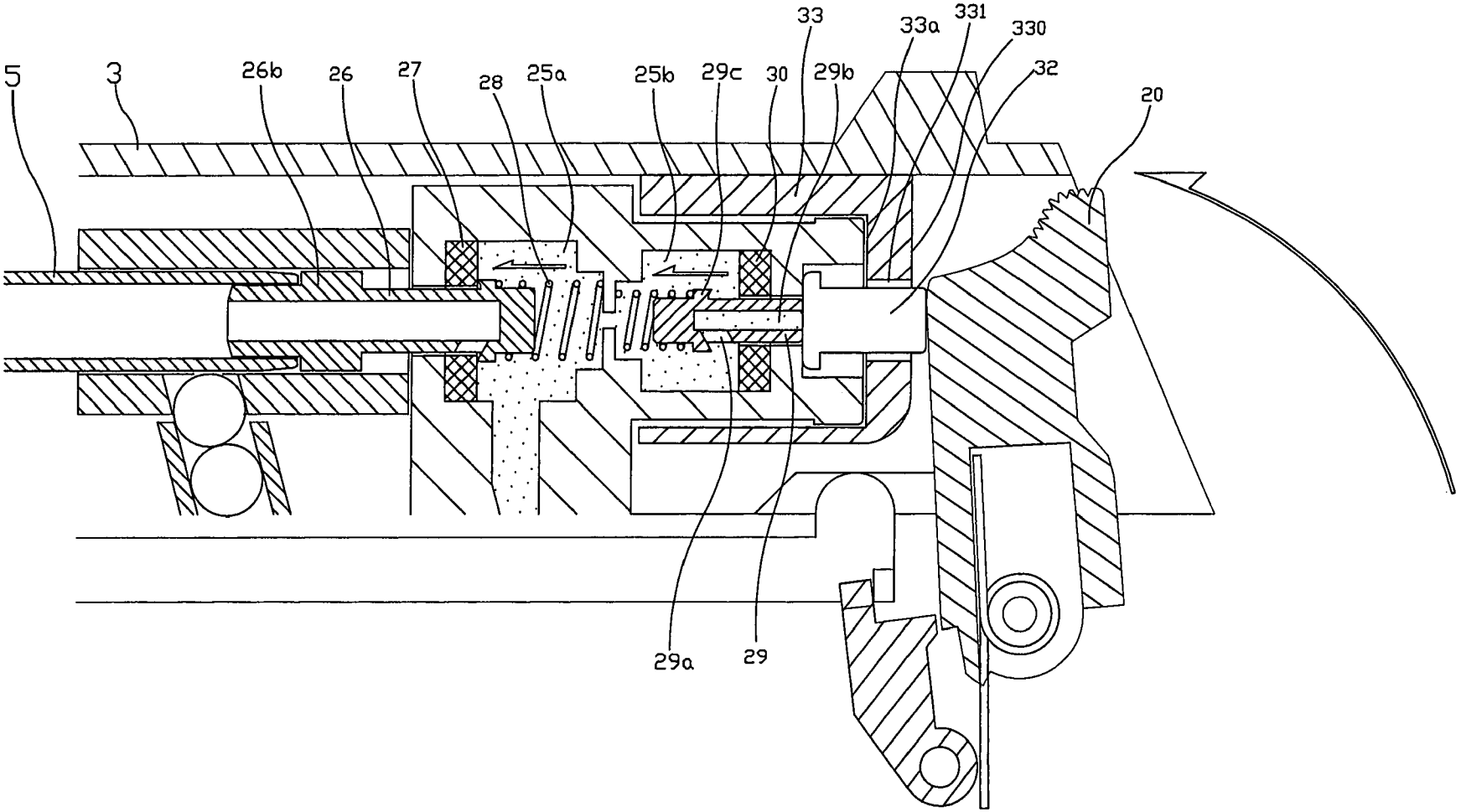
FIG. 20 is an essential enlarged explanatory drawing, being an essential enlarged drawing of FIG. 10, showing operation of the blowback air chamber and the blowback valve.

Next, FIG. 10 and FIG. 20 will be described. The hammer 20 rotates in an anti-clockwise direction, passes through a pin hole 331 in the rear end surface 330 of the cylinder 33, and hits a rear end surface of the hit pin 32 projecting from the cylinder 33. As a result, the hit pin 32 moves to the muzzle side, and the blowback valve 29 in contact with the hit pin 32 is caused to move to the muzzle side against the urging force of the blowback valve spring 31.

The blowback valve flange section 29*c* is separated from the blowback valve packing 30 by the forward movement of the blowback valve 29 towards the muzzle side, and together with this the blowback valve opening section 29*a* is also separated from the blowback valve packing 30 thus releasing the airtight state, and opening to the inside of the blowback air chamber 25*b*. In this manner, gas inside the blowback air chamber 25*b* passes from the blowback valve opening 29*a* through the gas passage 29*b* inside the blowback valve and flows out to a clearance of the cylinder pressure surface 33*a* that exists at a gun rear end side of the cylinder 33, and as a result of the cylinder pressure surface 33*a* pressing backwards the cylinder 33 and the slide 3 integrally provided with the cylinder 33 start to move backwards to the gun rear end side.

On the other hand, after firing of the bullet W, the bullet firing valve 26 slides to the muzzle side under the urging force of the bullet firing valve spring 28 that has been compressed, and the bullet firing valve large diameter section 26*b* presses the gun rear end of the inner barrel 5 it is in contact with to the muzzle side. Together with this, a bullet firing valve flange section 26*e* of the bullet firing valve 26 comes into contact with the bullet firing valve packing 27 of the bullet firing air chamber 25*a*, and the bullet firing valve opening section is closed by the bullet firing valve packing 27. This state is the same as the state shown in FIG. 1, so flow of gas from the bullet firing air chamber 25*a* is stopped, and the bullet firing air chamber 25*a* is put in an airtight state.

Figure 11:
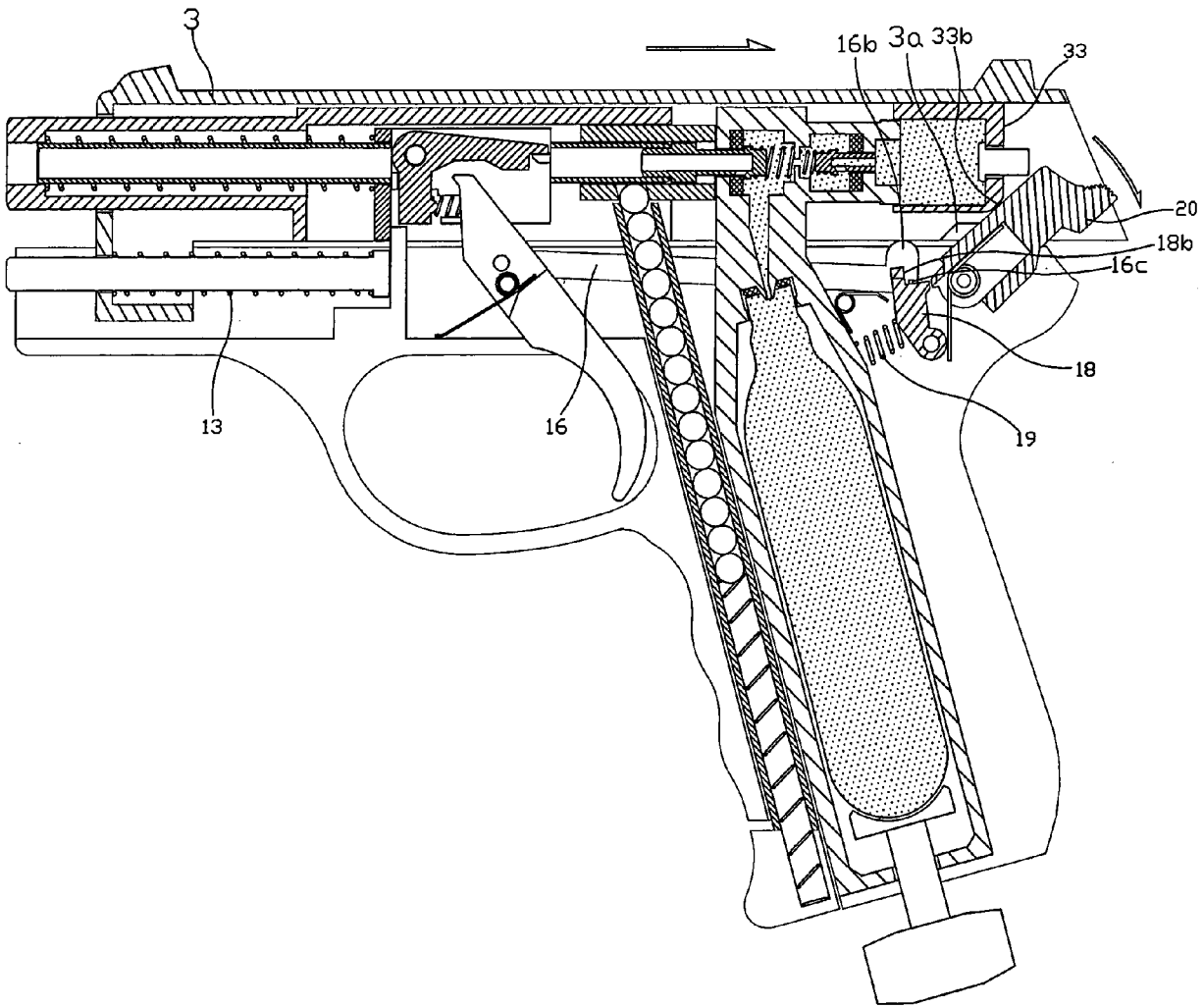
FIG. 11 is an internal explanatory drawing, being a central cross sectional front view, showing a state where movement of the slide to the gun rear end side by gas pressure from the blowback air chamber starts, after the state of FIG. 10.
Figure 21:
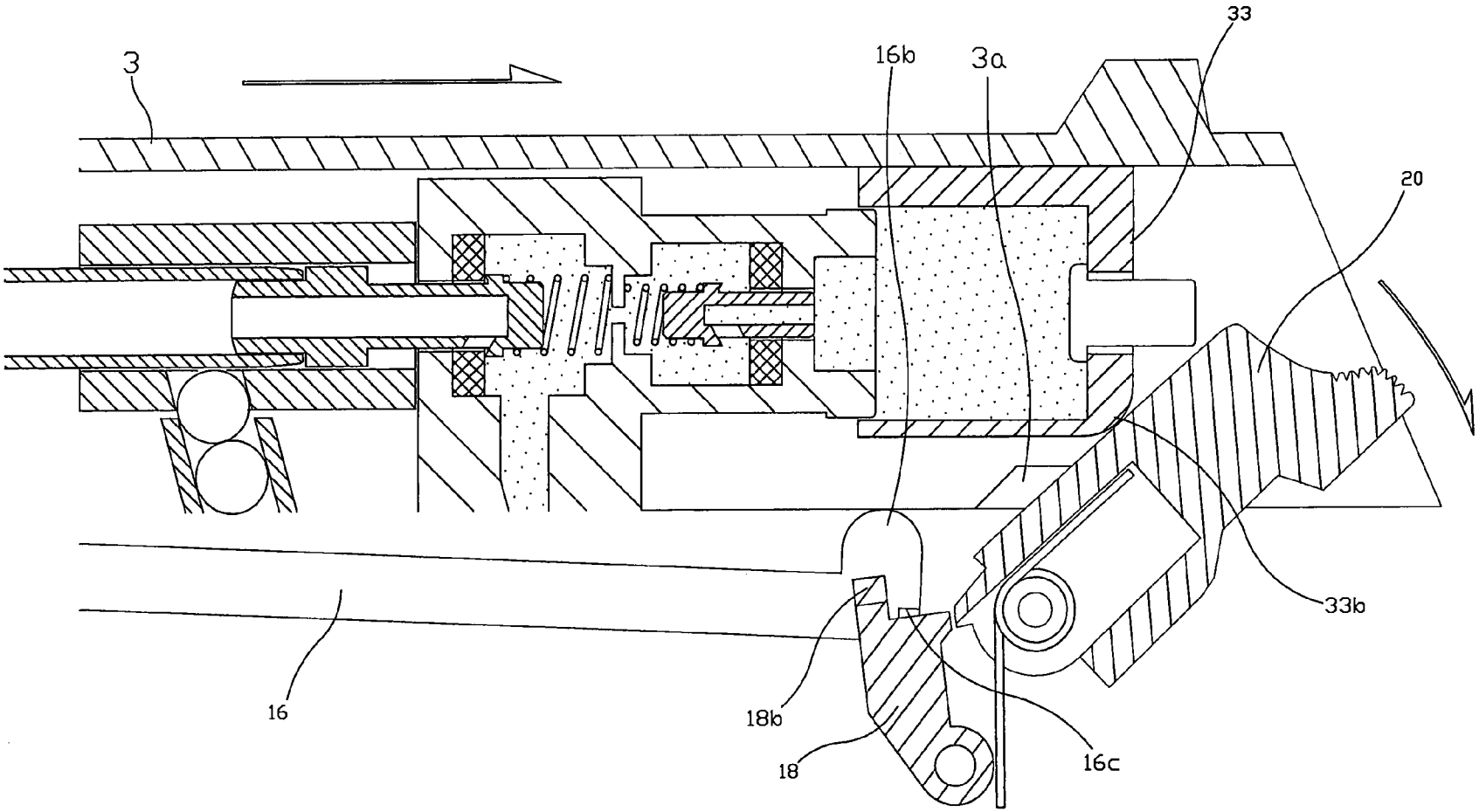
FIG. 21 is an essential enlarged explanatory drawing, being an essential enlarged drawing of FIG. 11, showing operation of the blowback air chamber and the blowback valve.

Next, FIG. 11 and FIG. 21 will be described. The slider 3 and the cylinder 33 continue to move further rearwards against the urging force of the recoil spring 13, because gas inside the blowback air chamber 25*b* continues to gush into the cylinder 33. As a result of a rear surface lower corner section 33*b* of the rearwardly moving cylinder 33 contacting and pressing the hammer 20, the hammer 20 is rotated about the hammer rotation shaft 20*b* clockwise towards the gun rear end side.

Accompanying movement of the slide 3 to the gun rear end side, the engagement lug section 16*b* of the trigger bar 16 slides on an inclined surface inside a disconnect indent 3*a* of the slide 3, to be pressed downwards in the gun. In this way, engagement between the trigger engagement lug section 18*b* of the shear 18 and the shear engagement lug section 16*c* of the trigger 16 is broken. The shear 18 rotates clockwise (to the hammer 20 side) about the shear shaft 18*c* under the urging force of the shear spring 19, and returns to a position engaged with the hammer 20.

Figure 12:
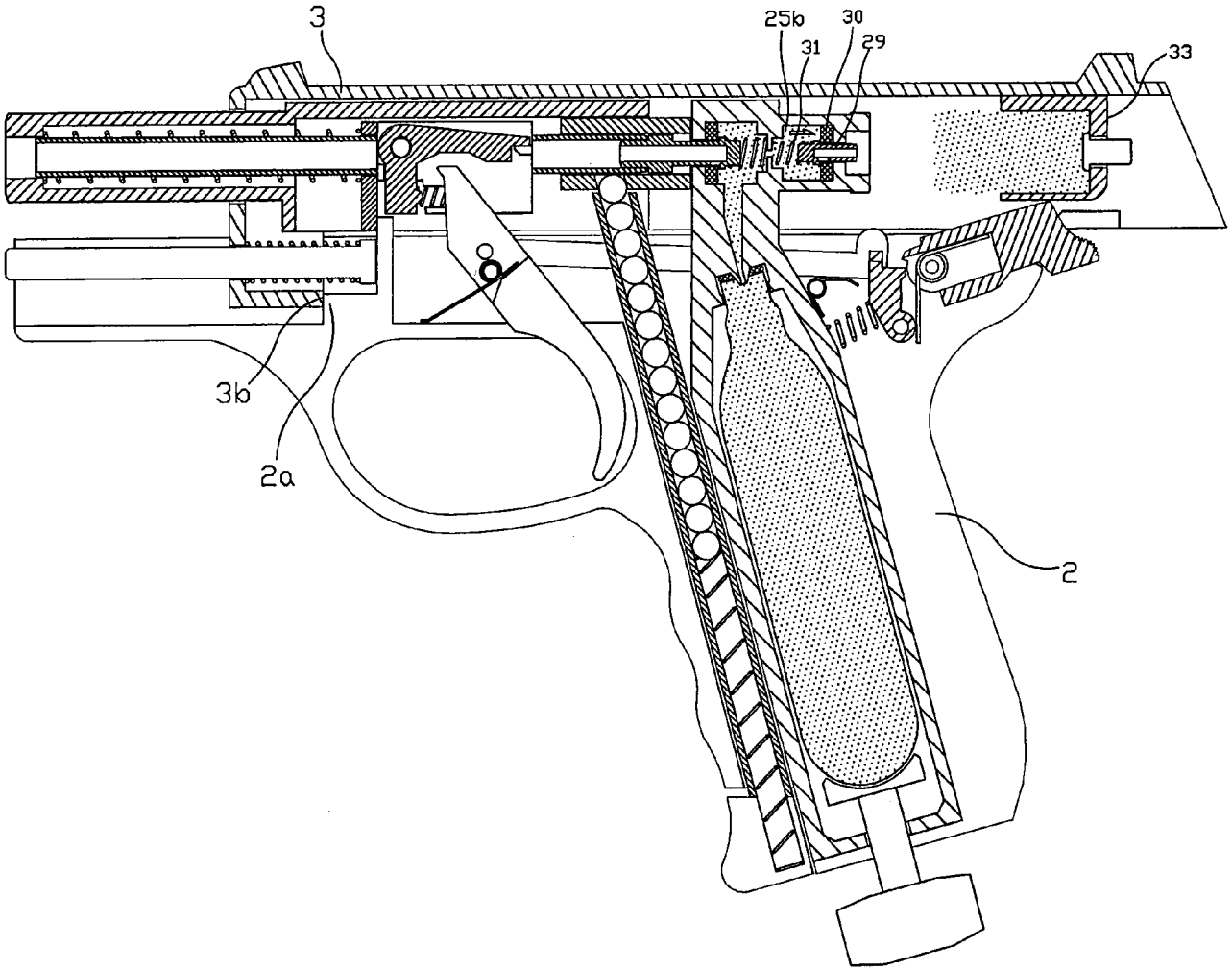
FIG. 12 is an internal explanatory drawing, being a central cross sectional front view, showing a state where the slide has been moved further to an end point, after the state of FIG. 11.

Next, FIG. 12 and FIG. 22 will be described. Rearward movement of the slide 3 is stopped by the slide engagement section 3*b* provided on the muzzle side lower section of the slide 3 coming into contact with the slide rearward movement prevention section 2*a* provided on the frame 2. At this time surplus gas remaining inside the cylinder 33 is discharged to the outside from the muzzle side opening section of the cylinder 33.

The blowback valve 29 slides to the gun rear end side due to the resilience of the compressed blowback valve spring 31. In this way, the blowback valve 29 has the blowback valve flange section 29*c* coming into contact with the blowback valve packing 30 of the blowback air chamber 25*b*, and at the same time the blowback valve opening section 29*a* is closed up by the blowback valve packing 30. This state is the same as the state shown in FIG. 1, so outflow of gas from the blowback air chamber 25*b* is stopped, and the blowback air chamber 25*b* is put in an airtight state.

Figure 13:
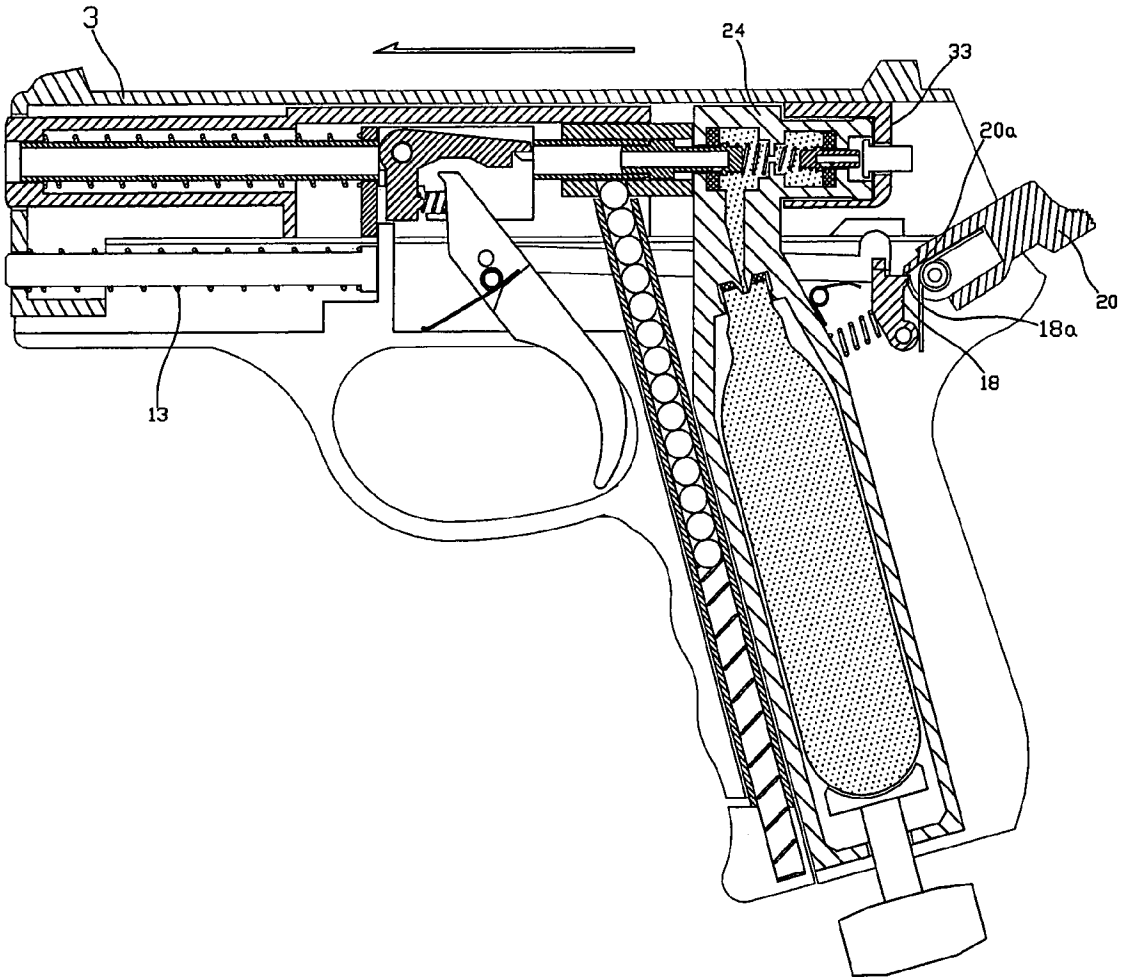
FIG. 13 is an internal explanatory drawing, being a central cross sectional front view, showing a state where the slide that has been moved to the end point is moving forward towards the muzzle side under the urging force of the barrel spring, after the state of FIG. 12.

Next, FIG. 13 and FIG. 23 will be described. The slide 3 starts to slide forwards towards the muzzle side under the urging force of the recoil spring 13. This forward movement causes a rear section of the valve body 24 to be inserted into the cylinder 33, and is stopped by contact between a cylinder pressure surface 33*a* inside the cylinder 33 and a gun rear end surface of the valve body 24.

The hammer 20 starts rotating in an anti-clockwise direction about the hammer shaft 20*b* due to the urging force of the hammer spring 21, but the shear locking section 20*a* of the hammer 20 comes into contact with the hammer locking section 18*a* of the shear 18 to stop the rotation of the hammer 20, and the hammer and the shear 18 are locked.

Next, FIG. 14 will be explained. If, from the state of FIG. 13, the user takes their finger off the trigger 14, the trigger 14 is returned to its original position (state of FIG. 1) by rotating in a clockwise direction about the trigger shaft 14*a* due to the urging force of the trigger spring 15.

The barrel latch 9 is then pushed up by the upper tip section 14*b* of the trigger 14 due to the movement of the trigger 14 returning to the original position. After that, at the point in time where the barrel housing engagement section 9*b* of the barrel latch 9 comes into contact with the barrel latch engagement section 8*a* of the barrel housing 8, the barrel latch 9 is locked.

Figure 14:
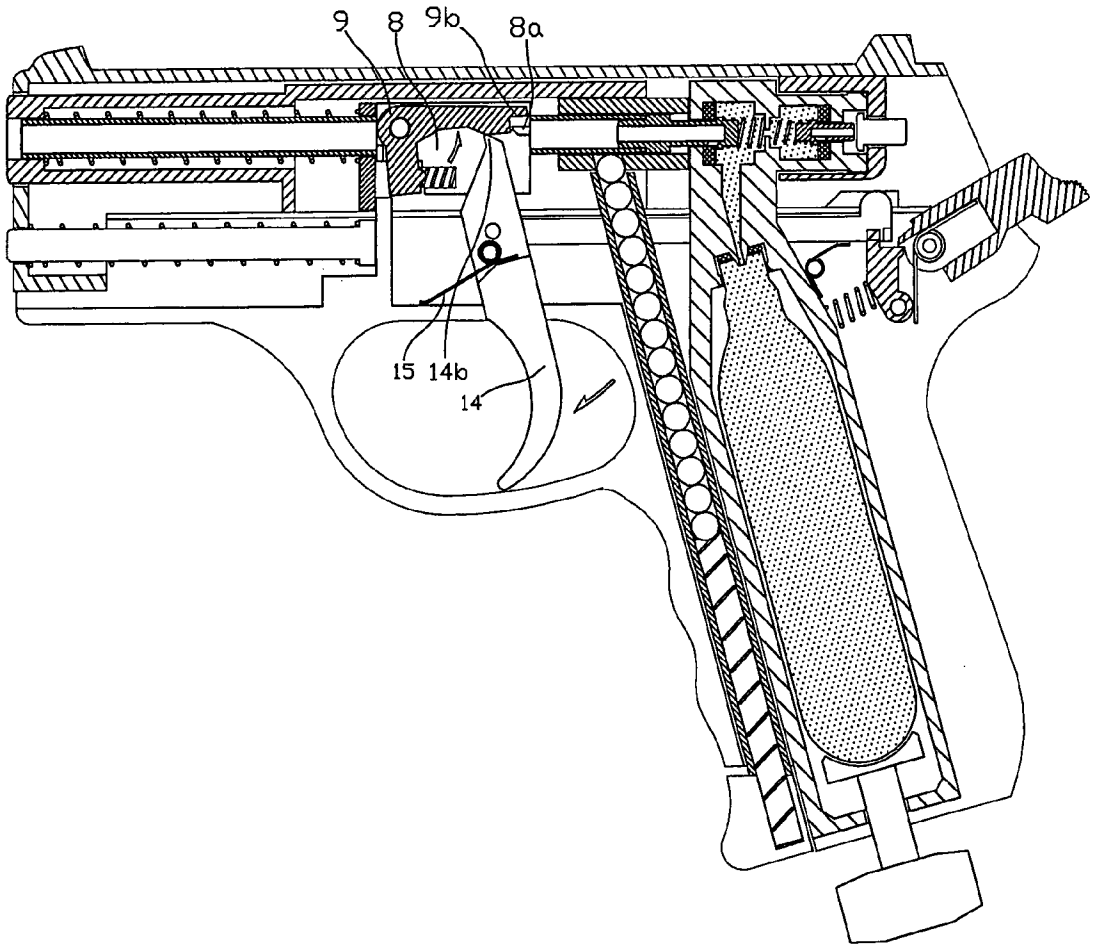
FIG. 14 is an internal explanatory drawing, being a central cross sectional front view, showing a state where the trigger has returned to its original state after a sequence of bullet firing and blowback operations have been completed, after the state of FIG. 13.

FIG. 14 is the same state as FIG. 4. Thus, when firing the next bullet it is possible to repeat the series of operation by sequentially following the operation of FIG. 5 to FIG. 14.

The present invention is used as an air gun having a blowback function.

What is claimed is:

1. An air gun, for firing a bullet using compressed gas, comprising:

a blowback mechanism operative for carrying out blowback, wherein the blowback mechanism includes:

a valve body defining a firing chamber cavity and a blowback chamber cavity in fluid communication with the firing chamber cavity, the firing chamber cavity and the blowback chamber cavity being sealed to contain compressed gas inside the valve body, a firing valve disposed inside the firing chamber cavity, and a blowback valve disposed inside the blowback chamber cavity, wherein the firing valve is first opened by actuation of a barrel latch actuated by a trigger operation, and thereafter the blowback valve is opened by actuation of a hammer actuated by the trigger operation, and wherein the firing valve and the blowback valve are each operative to move, independently of one another, between a valve opened position and a valve closed position.

2. The air gun of claim 1, wherein the firing chamber cavity and the blowback chamber cavity are connected by a narrow connection passage having a small volume compared to the volumes of the respective firing and blowback chamber cavities.

* * * * *